US011098722B2

(12) United States Patent
Woody

(10) Patent No.: US 11,098,722 B2
(45) Date of Patent: Aug. 24, 2021

(54) INTERNAL COMBUSTION BOUNDARY LAYER TURBINE ENGINE (BLTE)

(76) Inventor: Daniel Woody, Troy, MI (US)

( * ) Notice: Subject to any disclaimer, the term of this patent is extended or adjusted under 35 U.S.C. 154(b) by 944 days.

(21) Appl. No.: 13/452,810

(22) Filed: Jun. 22, 2012

(65) Prior Publication Data

US 2013/0039744 A1 Feb. 14, 2013

Related U.S. Application Data

(60) Provisional application No. 61/477,310, filed on Apr. 20, 2011.

(51) Int. Cl.
*F04D 17/16* (2006.01)
*F01D 1/36* (2006.01)
*F04D 23/00* (2006.01)

(52) U.S. Cl.
CPC ..... *F04D 17/161* (2013.01); *F01D 1/36* (2013.01); *F04D 23/00* (2013.01)

(58) Field of Classification Search
CPC ..... F04D 17/161; F04D 23/00; F01D 1/36
USPC ..... 415/90
See application file for complete search history.

(56) References Cited

U.S. PATENT DOCUMENTS 2,632,598 A * 3/1953 Wales, Jr. ..... 416/4
2,997,847 A * 8/1961 Hollingsworth ..... F02C 6/20 60/39.38
3,880,361 A * 4/1975 Schwarz ..... 241/36
4,025,225 A * 5/1977 Durant ..... 415/90
4,052,144 A * 10/1977 Marek ..... F23R 3/30 431/352
4,280,791 A * 7/1981 Gawne ..... 415/90
4,534,699 A * 8/1985 Possell ..... F01D 17/165 415/42
4,655,679 A * 4/1987 Giacomel ..... F01D 17/141 415/90
5,676,321 A * 10/1997 Kroger ..... 241/236
6,328,527 B1 * 12/2001 Conrad ..... A47L 5/22 415/90
6,779,964 B2 * 8/2004 Dial ..... F01D 1/36 415/1
8,863,530 B2 * 10/2014 Bergen ..... F23R 3/52 60/805
2006/0216149 A1 * 9/2006 Wilson ..... F03D 1/0608 416/4

(Continued)

*Primary Examiner* — Ninh H. Nguyen
*Assistant Examiner* — Jason Fountain
(74) *Attorney, Agent, or Firm* — Leavitt Eldredge Law Firm

(57) ABSTRACT

This invention, the "Internal Combustion Boundary Layer Turbine Engine" (BLTE), embodies the description of a "flat-disk radial flow turbine engine". The BLTE uses the effects of "working fluid" or "exhaust" drag to convert the pressure of fuel combustibles to kinetic output energy in the form of a driven shaft. The BLTE application of "differentially sized flat blades" solves the problem of internal combustion and multi-stage operation for this new category of engine.

This engine offers the light weight and high power output capability of a continuous or pulsed burn-mode of a radial turbine engine. Relative to conventional radial flow turbine engines, this engine provides reduced exhaust flow, reduced emissions and offers simple, inexpensive construction with commonly available machine tools.

2 Claims, 17 Drawing Sheets

(56) References Cited

U.S. PATENT DOCUMENTS

| | | | | |
|---|---|---|---|---|
| 2011/0097189 | A1* | 4/2011 | Sandoval | F02C 7/08 415/68 |
| 2012/0014779 | A1* | 1/2012 | Gilliam | F04D 5/001 415/90 |

* cited by examiner

Notes:
Grey dotted lines are construction lines.

INTERNAL COMBUSTION BOUNDARY LAYER TURBINE ENGINE (BLTE)

BACKGROUND

1. Field of the Invention

This invention relates to an apparatus used to transmit motive force between a fluid and a plurality of spaced apart rotatable members. The apparatus may be used to transmit the motive force from a fluid to the spaced members or, alternately, from the spaced apart members to the fluid.

2. Description of Related Art

Taught first by Doctor Nicola Tesla in U.S. Pat. Nos. 1,061,142 and 1,061,206 (Tesla), disclosure of which is incorporated herein by reference. In both disclosures the rotor (runner) comprises a stack of flat circular disks with spoke openings in the central portions, with the disk being set slightly apart. In the propulsion embodiment, fluid enters the system at the center of the rotating disks and is transferred by means viscous drag to the periphery where it is discharged tangentially. In the turbine embodiment, fluid enters the system tangentially at the periphery and leaves it at the center. As taught by Doctor Nikola Tesla, the use of a boundary layer (adherence and viscosity) to communicate motive force on a plurality of rotating disks improves upon the art of propulsion. Doctor Tesla teaches "It may also be pointed out that such a pump can be made without openings and spokes in a runner by using one or more solid disks each in its own solid casing to form a machine that will be eminently adapted for sewage, dredging and the like, when the water is charged with foreign bodies and spokes or vanes are especially objectionable". Doctor Tesla also teaches "Besides, the employment of the usual devices for imparting to, or delivering energy from a fluid, such as positions, paddles, vanes and blades necessarily introduce defects and limitations and adds to the complication, cost of production and maintenance of the machine". Prior art has employed pin attachments, channels and spokes to obtain a rotor design with an open center. It is considered that this arrangement of spokes, pins, channels is not desirable in the propulsion or turbine devices for the following reasons: a. Pin attachments used to retain and space the plurality of rotor disks travel a particular path in relation to the spiral path of the fluid flow may cause a disrupted flow pattern and generate a turbulent interference patterns to disrupt the desirable laminar flow that provides an optimal boundary layer effect for maximum uniform cohesion of the fluid to the disk(s). b. A disk rotor supported in a cantilever fashion to allow an open end for fluid passage through an open center provides a radius of rotation causing vibration in the fluid and disk rotor increasing boundary layer disruption. c. Spokes used to attach disks to a rotating axle provide unequal mass distribution of the disks which under high speed rotation result in stress causing deformation of the disk surface, vibration known to cause disruption of the boundary layer viscous flow and possible disk failure.

Doctor Tesla teaches that the highest economy is obtained when for any given speed the slip should be as small as possible. As the boundary layer effect is enhanced by viscous flow reducing slip, therefore, turbulent flow reduces viscous flow increasing slip.

The picture a "disk stack" concept rendered in 3D CAD. Take notice of the (71) bumps on the disk surfaces and the (80) star washer in front of the first disk shown, these devices are employed to maintain disk spacing. This drawing shows disks and star washers with slots, as opposed to tabs (referred to in the remainder of this document) in the central hub. This slotted version was originally designed to mate with a (101) tabbed shaft and is referred to as a possible mounting option in the "Shaft Construction" section. This picture is for information only and demonstrates the design flexibility of the BL TE. The arrow indicating 0° (zero degrees) is the location on the disks where the disk slot or tab aligns with the inner and outer bump locations.

Figure 2:
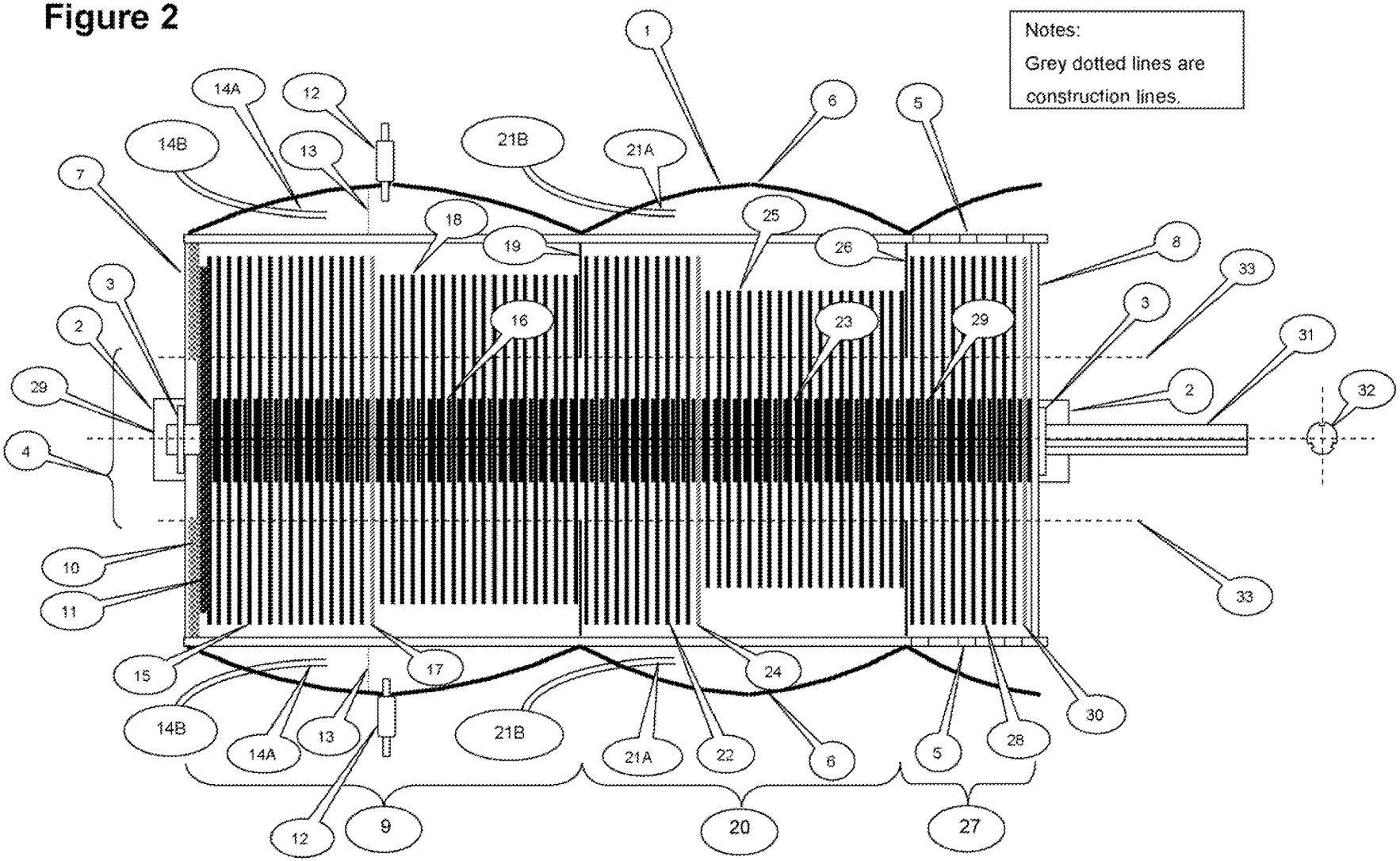

Disk Stack—CAD Rendering:

71) Bumps
72) 0° slot or tab position
73) 120° slot or tab position
74) 240° slot or tab position
80) Star Washer FIG. 2—Complex BL TE Construction Description: Schematic Construction of the Complex Internal Combustion BL TE (Side View)

Figure 3:
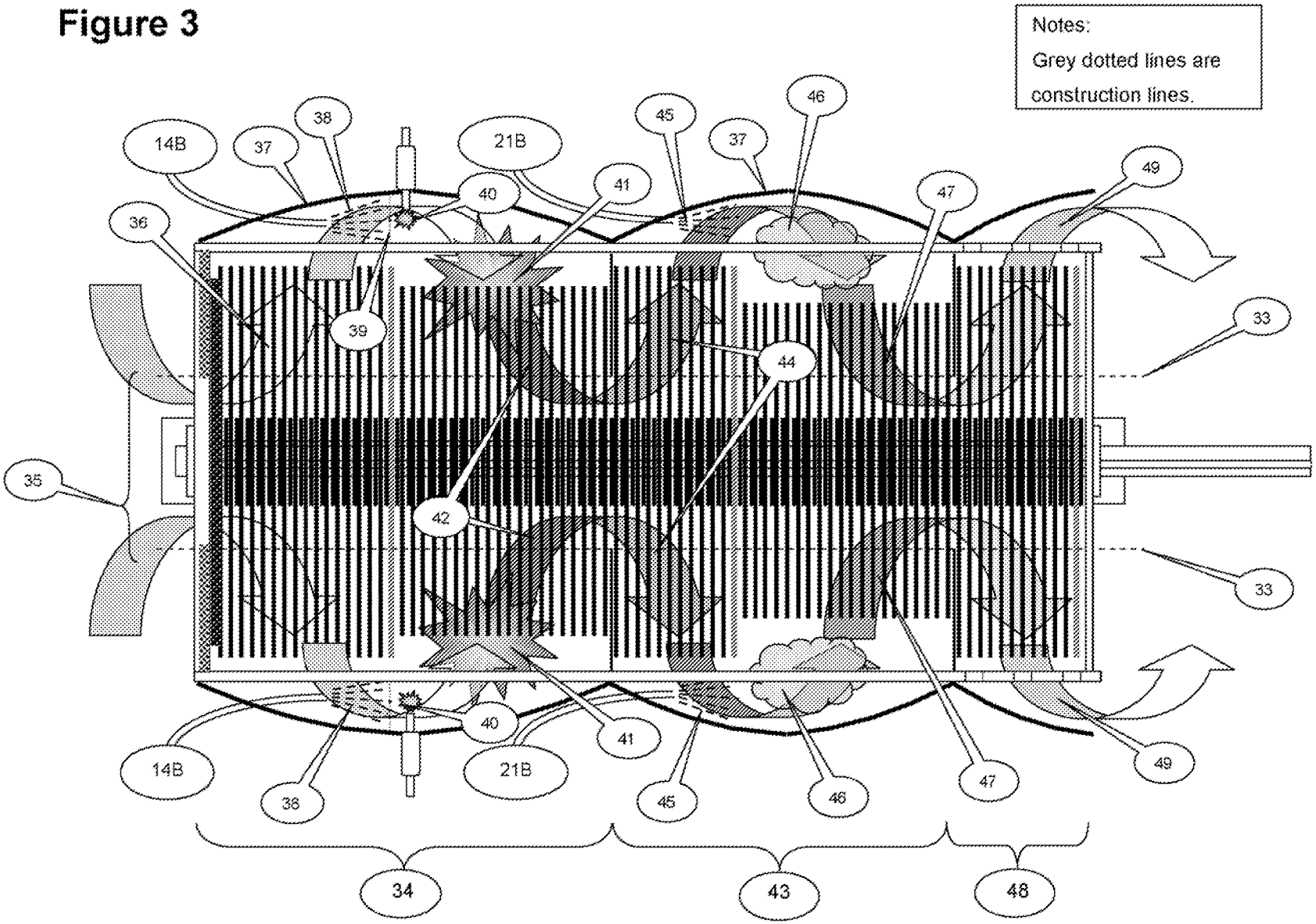

1) Chassis (also see Cylinder Chassis)
2) Bearing Housings
3) Frictionless Bearings
4) Intake Ports
5) Exhaust Ports
6) Bubble Chassis Enclosure (also see Cylinder Chassis)
7) Front Chassis Cover (ported)
8) Rear Chassis Cover (port-less)
9) Main Stage 1
10) Female Labyrinth Seal
11) Male Labyrinth Seal
12) Igniter
13) Flame Barrier
14A) Fuel Injector
14B) Fuel Reservoir
15) Compression Disk Stack
16) Star Washers
17) Shaft Mounted Baffle Disk
18) Exhaust/Power Disk Stack
19) Chassis Mounted Baffle Disk
20) Main Stage 2
21A) Fuel/Water Injector
218) Fuel/Water Reservoir
22) Compression Disk Stack
23) Star Washers
24) Shaft Mounted Baffle Disk
25) Exhaust/Power Disk Stack
26) Chassis Mounted Baffle Disk
27) Post Exhaust/Evacuation Auxiliary Stage
28) Exhaust Evacuation Disks (optional)
29) Star Washers
30) Shaft Mounted Baffle Disk
31) Slotted Shaft (or Keyed Shaft}
32) Shaft End View
33) Outer Port Radius FIG. 3—Complex BL TE Operation Description:

34) Main Stage 1
35) Air Intake Centrifuge/Compressor Intake Ports
36) Air Compression
37) Chassis Containment/Pressure Vessel
38) Fuel Injection
39) Flame Barrier
40) Ignition
41) Combustion

42) Exhaust/Power Flow (Stage 1—larger power recovery disks)
43) Main Stage 2
44) Exhaust/Evacuation (compression)
45) Power Boost Water/Air Injection (or after-burn fuel injection)
46) Water Vaporization/Air Expansion (or auxiliary ignition)
47) Exhaust/Power Flow (Stage 2—smaller power recovery disks)
48) Auxiliary Stage
49) Exhaust Evacuation (optional)

FIG. 4—Schematic Diagram of the Complex BL TE Disks (front views)

Figure 4A:
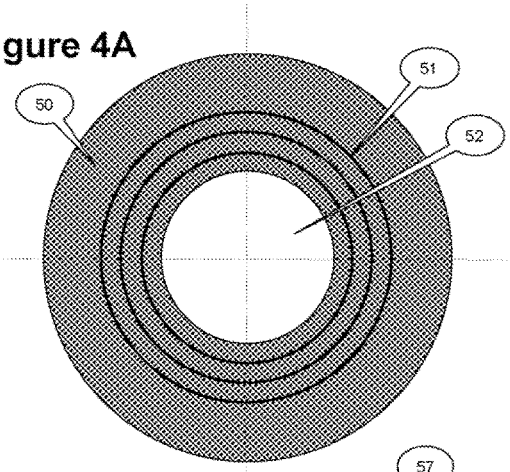
Figure 4B:
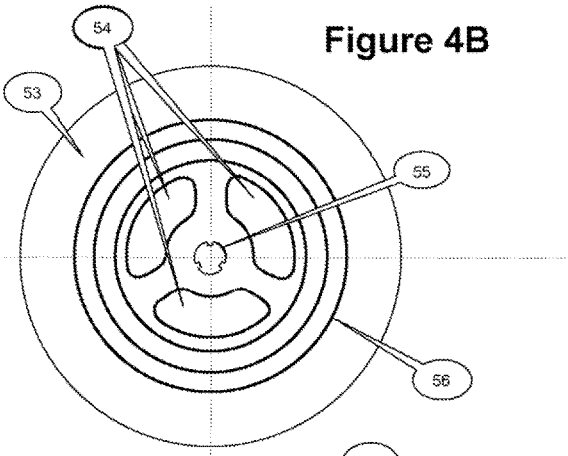
Figure 14A:
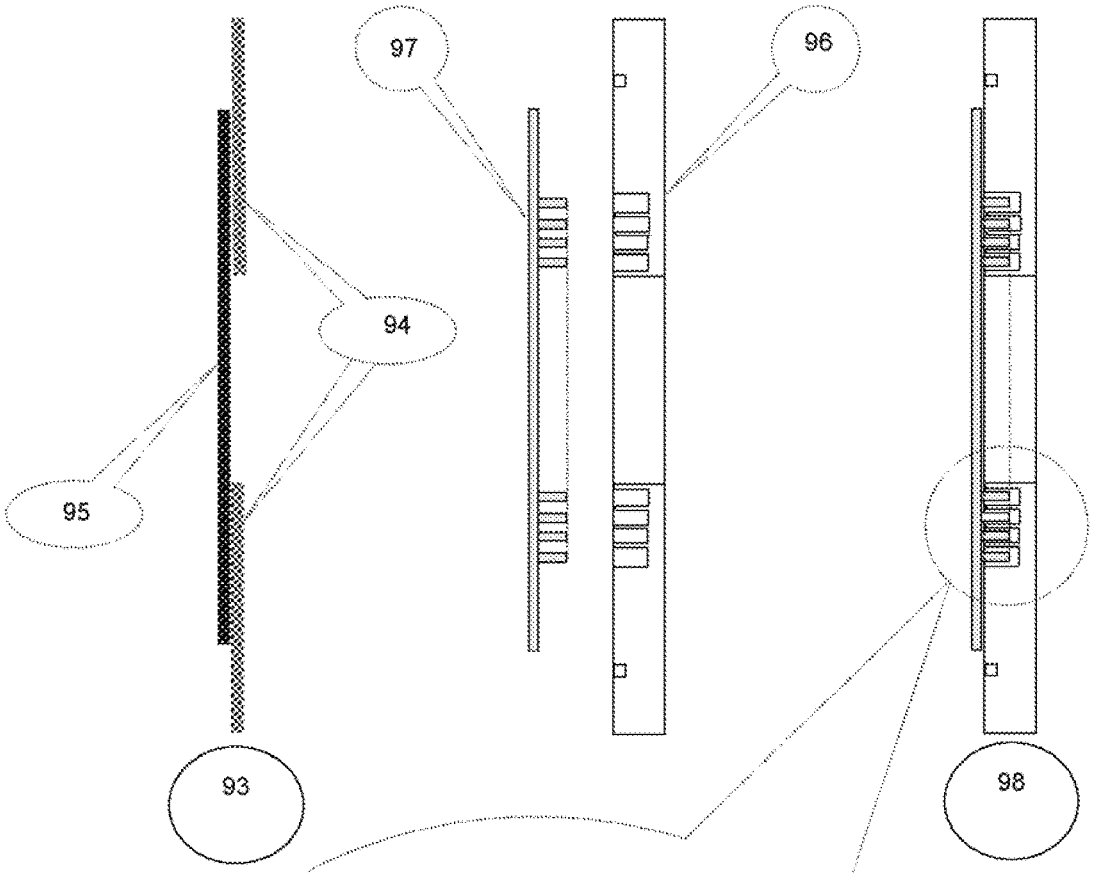
Figure 14B:
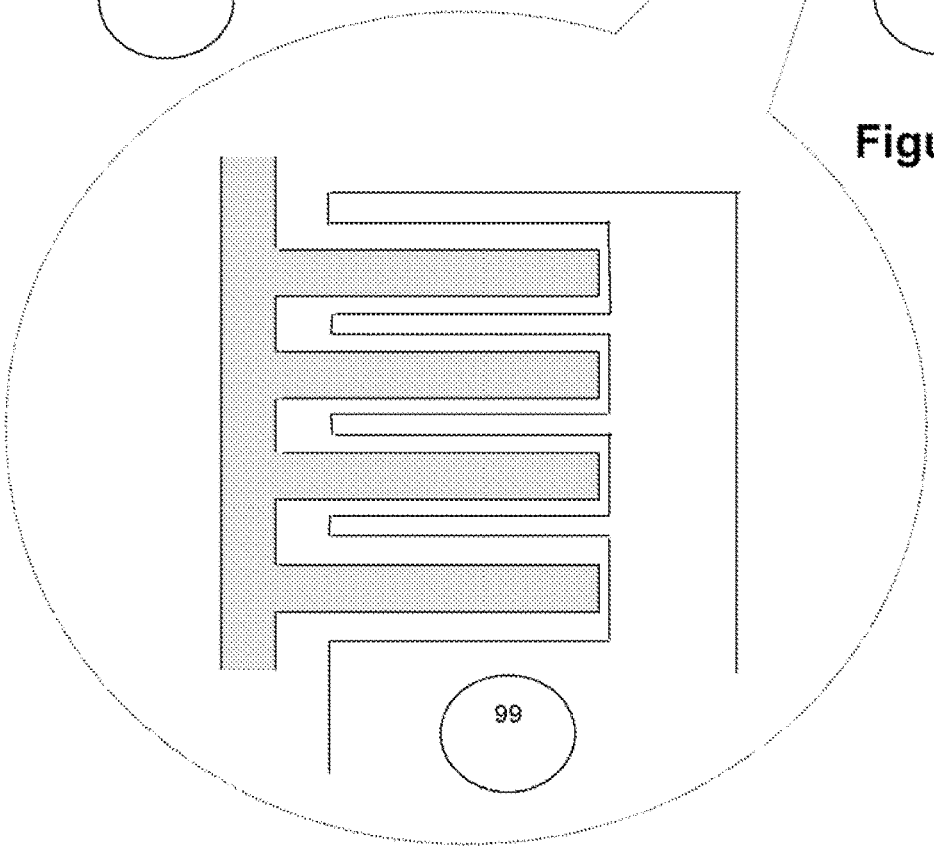

FIG. 4A—Chassis Mounted (96) Female Labyrinth Disk
50) Smooth area of labyrinth seal disk
51) Labyrinth troughs recessed from surface (see FIGS. 14A & 14B)
52) Port orifice allows intake or exhaust fluids to pass FIG. 4B—Shaft Mounted (95) Male Labyrinth Disk
53) Smooth area of labyrinth seal disk
54) Central intake/exhaust ports
55) Tabbed shaft hub
56) Labyrinth lands protruding from surface (see FIGS. 14A & 14B)

Figure 4C:
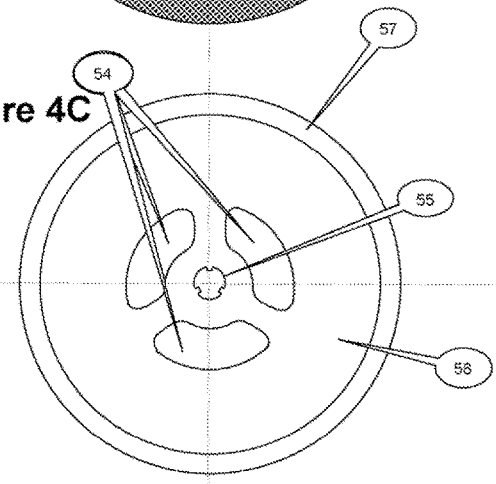

FIG. 4C—Compression and Large Power/Exhaust Disks
54) Central intake/exhaust ports
55) Tabbed shaft hub
57) Compression disk
58) Power disk (larger of the power disks)

Figure 4D:
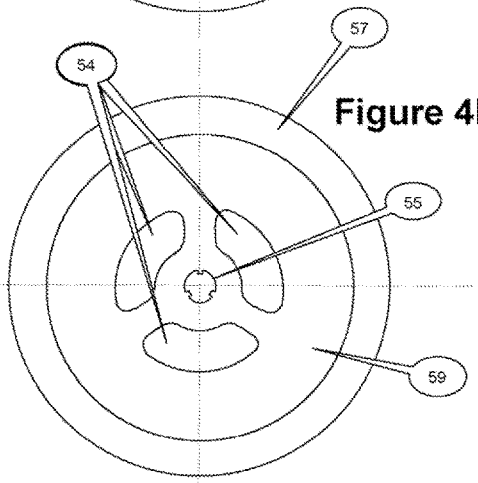

FIG. 4D—Compression and Small Power/Exhaust Disks
54) Central intake/exhaust ports
55) Tabbed shaft hub
57) Compression disk
59) Power disk (smaller of the power disks)

Figure 4E:
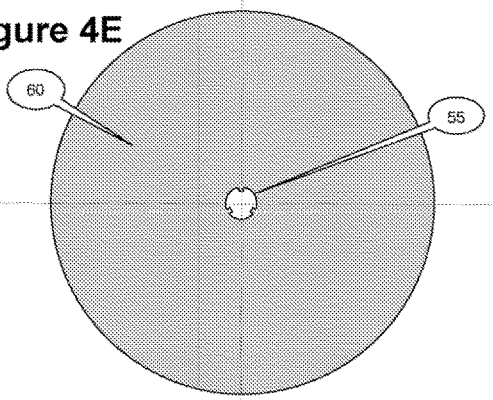
Figure 4F:
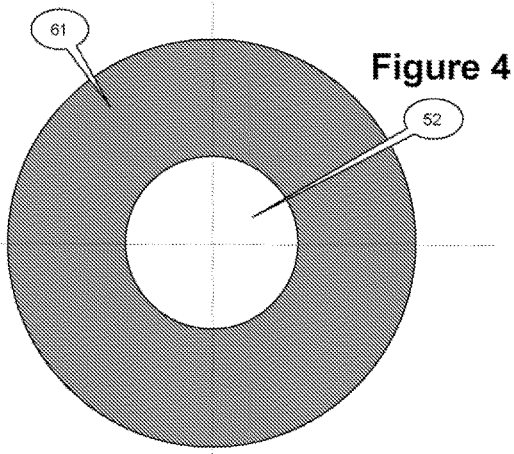
Figure 5:
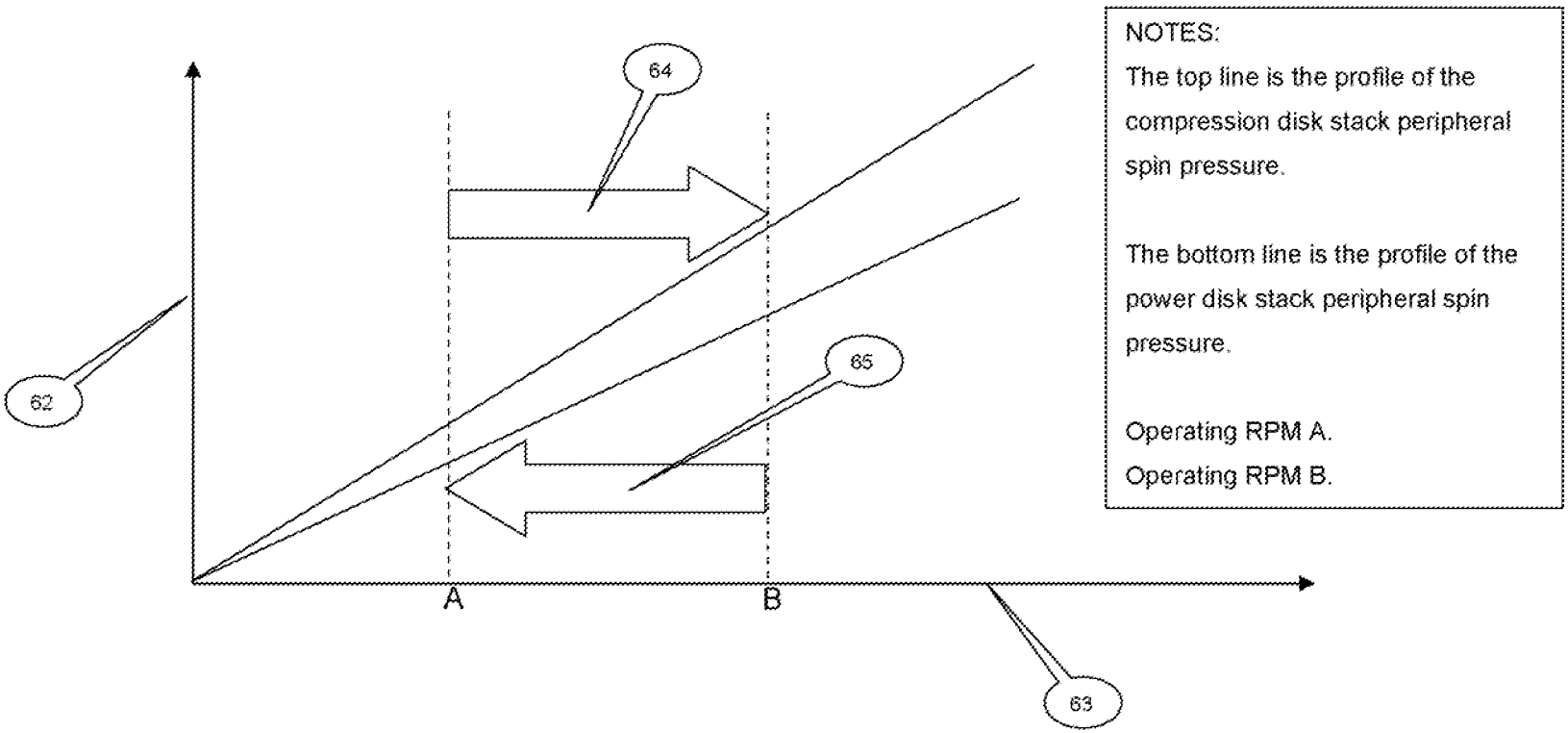

FIG. 4E—Shaft Mounted Baffle Disk
60) Smooth shaft mounted baffle disk
55) Tabbed shaft hub FIG. 4F—Chassis Mounted Baffle Disk (for Complex BL TE only)
61) Smooth chassis mounted baffle disk
52) Tabbed shaft hub FIG. 5—Compression and Power/Exhaust disk stacks Pressure Diagram
62) Spin pressure
63) Spin RPM
64) Combustion event
65) Loading event FIG. 6—Compound Internal Combustion BL TE (Side View). This drawing illustrates the fundamental component, the Main Stage (9), of the Internal Combustion BLTE and the (optional) Exhaust Evacuation (27) auxiliary stage. Of all the stages and auxiliary stages that can be combined to produce a Compound BL TE these two components are the most likely to appear in a minimal configuration.

Figures 6A, 6B, 6C:
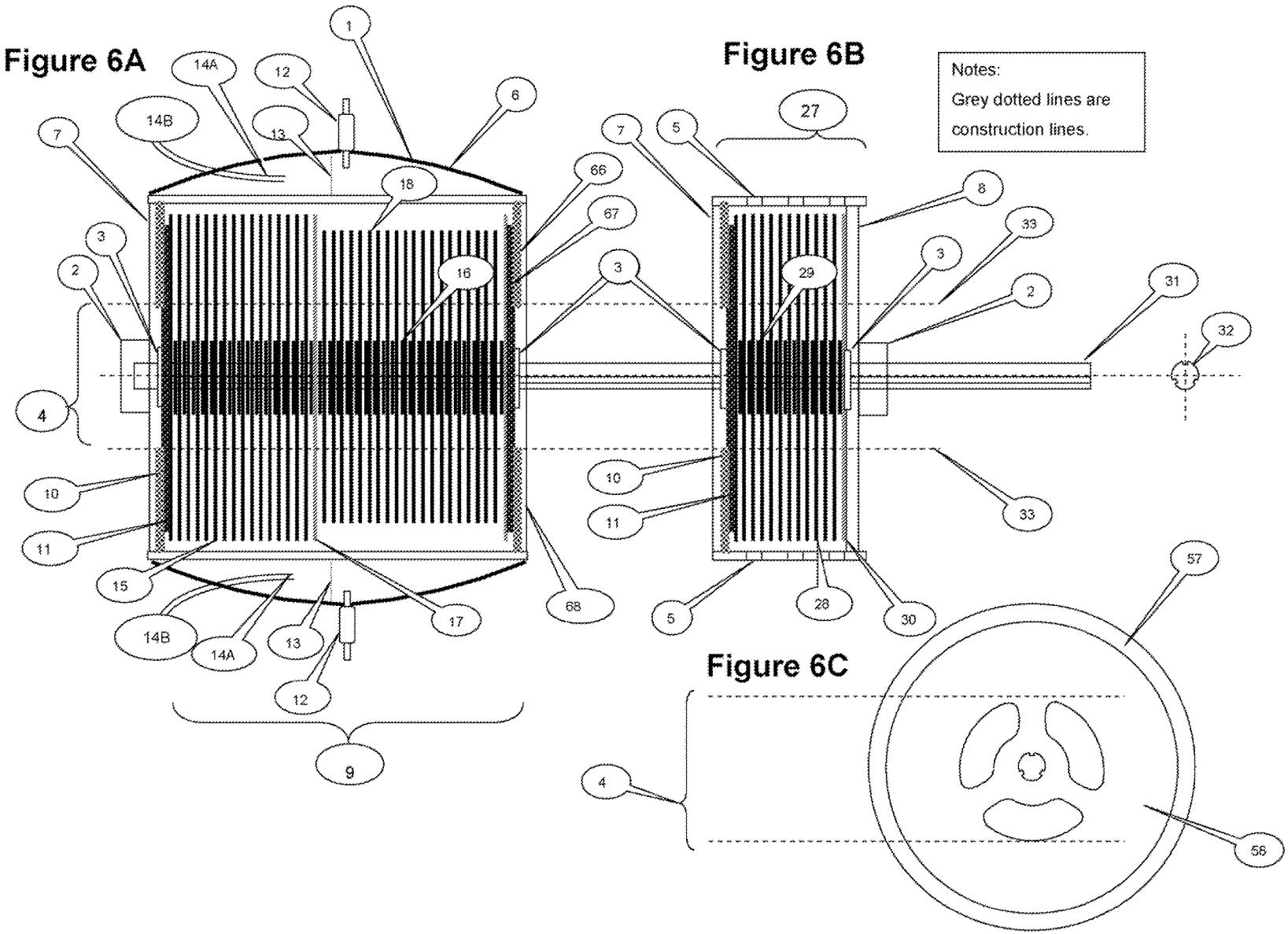

FIG. 6A—Main Stage Detail
1) Chassis
2) Bearing Housings
3) Frictionless Bearings
4) Intake Ports
5) Exhaust Ports
6) Bubble Chassis Enclosure (also see Cylinder Chassis)
7) Chassis-Cover (ported)
8) Chassis Cover {port-less)
9) Main Stage 1
10) Front Female (chassis mounted-lighter pattern) Labyrinth Seal
11) Front Male (shaft mounted-dark pattern) Labyrinth Seal
12) Igniter
13) Flame Barrier
14A) Fuel Injector
14B) Fuel Reservoir
15) Compression Disk Stack
16) Star Washers
17) Shaft Mounted Baffle Disk
18) Exhaust/Power Disk Stack
19) Rear Female (chassis mounted-lighter pattern) Labyrinth Seal
20) Rear Male (shaft mounted-dark pattern) Labyrinth Seal
66) Rear Female (chassis mounted-lighter pattern) Labyrinth Seal
67) Rear Male (shaft mounted-dark pattern) Labyrinth Seal
68) Chassis Cover (ported)

FIG. 6B—Auxiliary Stage Detail (Evacuation/Exhaust)
27) Auxiliary Exhaust/Evacuation Stage
2) Bearing Housings
3) Frictionless Bearings
4) Intake Ports
5) Exhaust Ports
7) Chassis Cover (ported)
8) Chassis Cover (port-less)
28) Exhaust/Evacuation Disk Stack
29) Star Washers
30) Shaft mounted baffle disk
31) Shaft
32) Shaft end view (slotted)
33) Outer port radius FIG. 6C—Main and Auxiliary (Evacuation/Exhaust) Stage Disk Detail
4) Intake Port Diameter (Outer Port Diameter)
57) Compression disk
58) Power disk (larger of the power disks)

Figure 7:
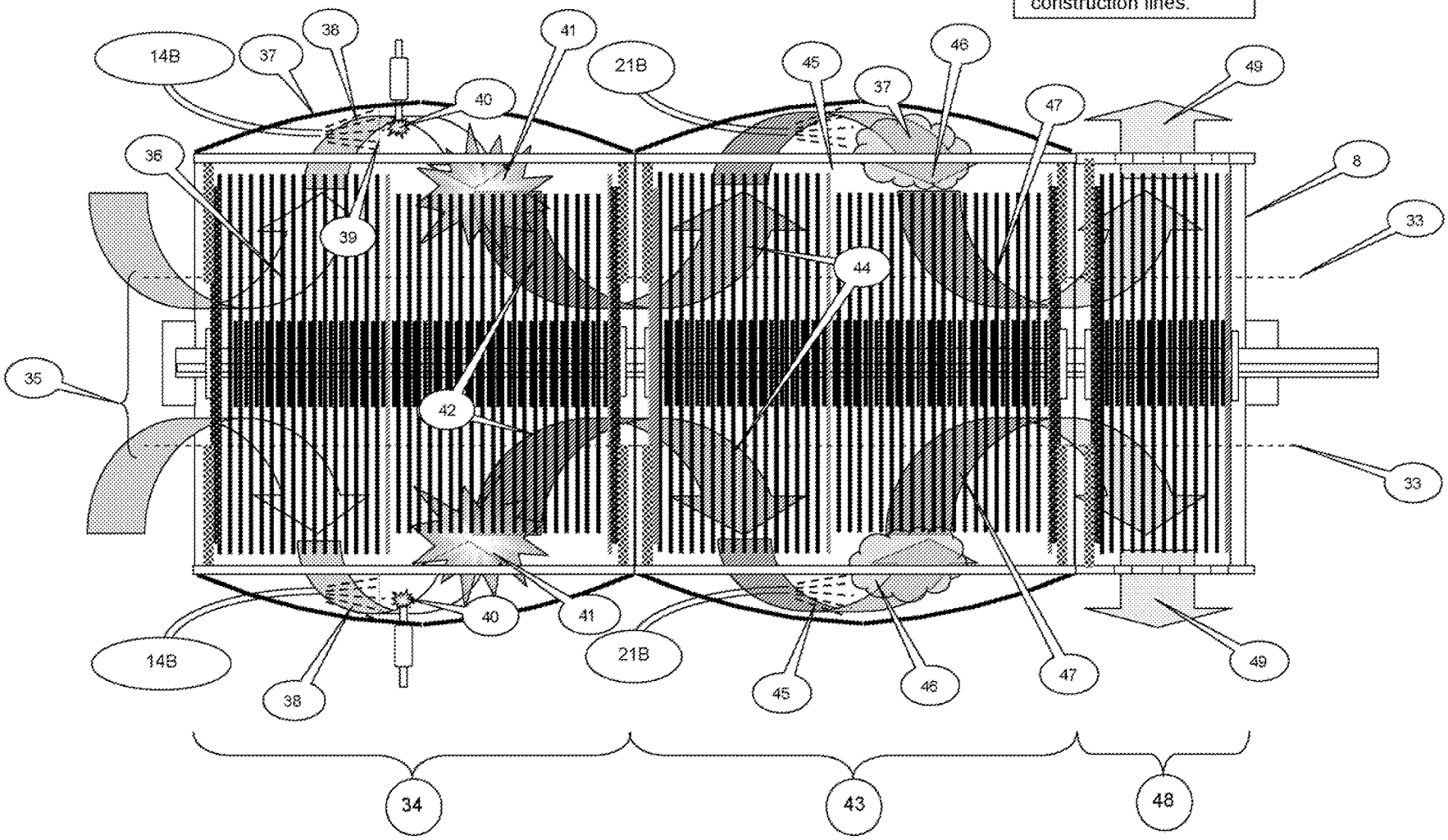

FIG. 7—Compound BI TE Operation Description:

Schematic Operation of Two Main Stages and Auxiliary Stage of a Compound Internal Combustion BL TE (Side View)

This section describes the operation of a Compound BL TE configured as two Main Stages and an Auxiliary Exhaust/Evacuation Stage. This operation is exactly the same as the Complex BL TE as described previously with the exception that more {optional) main and auxiliary stages may be added to enhance BL TE operation.

34) Main Stage 1
35) Air Intake Centrifuge/Compressor Intake Ports
36) Air Compression
37) Chassis Containment/Pressure Vessel
38) Fuel Injection
39) Flame Barrier
40) Ignition
41) Combustion
42) Exhaust/Power Flow (Stage 1—larger power recovery disks)
43) Main Stage 2 (optional)
44) Evacuation/Compression
45) Power Boost Water/Air Injection (or after-burn fuel injection)
46) Water Vaporization/Air Expansion (or auxiliary ignition)
47) Exhaust/Power Flow (Stage 2—smaller power recovery disks)
48) Auxiliary Stage (optional)

49) Exhaust Evacuation

Figure 1:
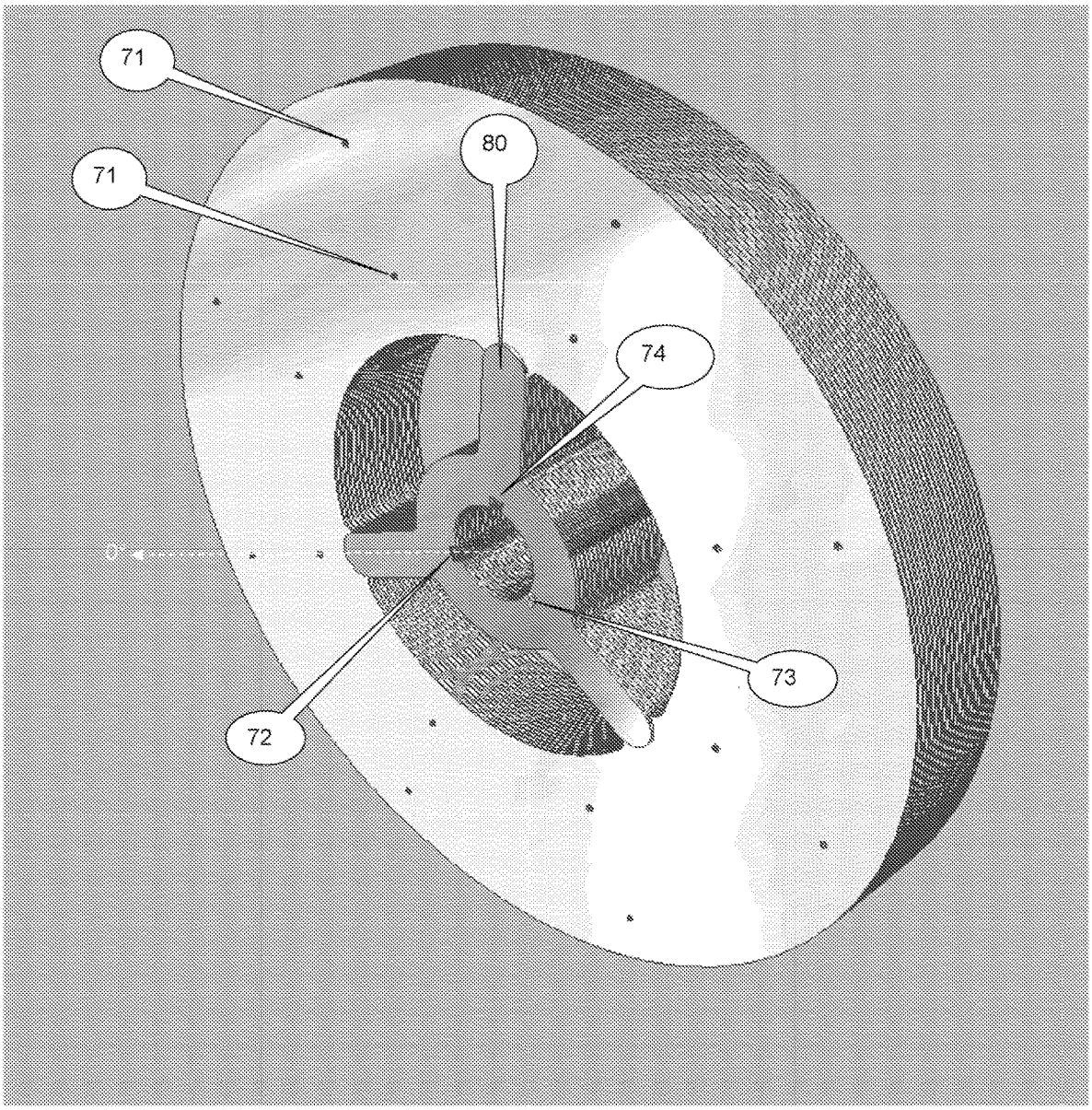
FIG. 1—CAD Rendering.
Figure 8:
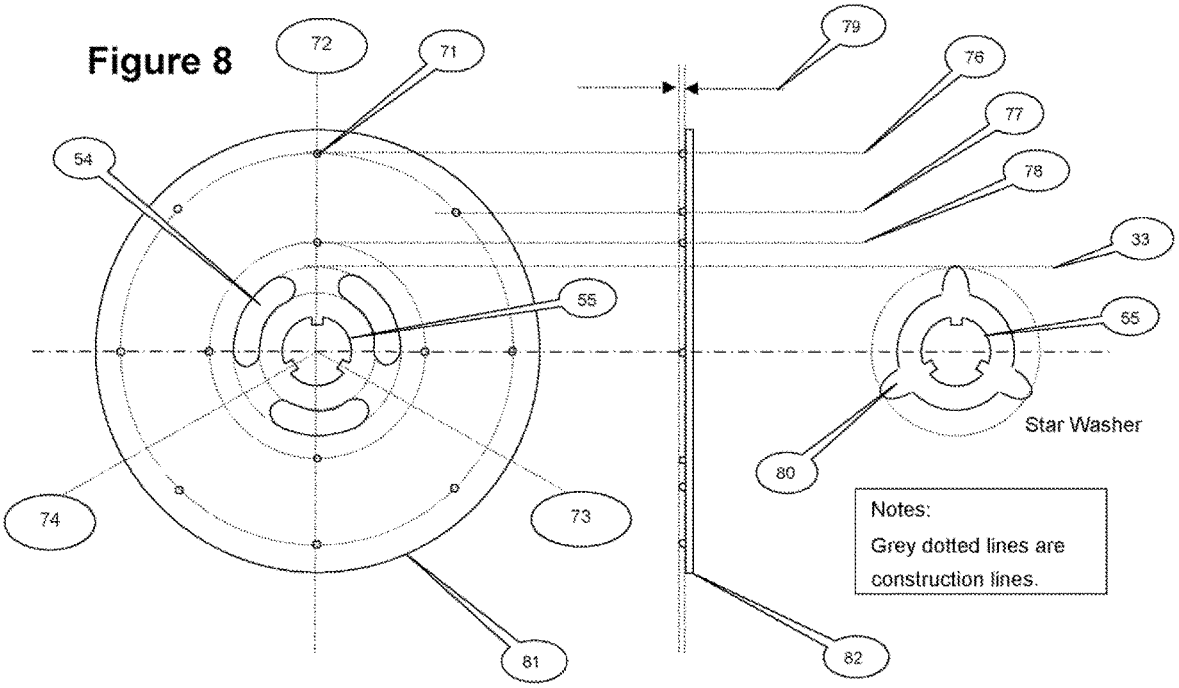

FIG. 8 Details of a Power Disk:

The power disk is made with a smooth thin stainless material which can be stamped from a roll of material of the desired thickness; for this discussion. Each power disk will have the same construction. The power disks have a front and rear side which is determined by the protrusion of bumps (front) and upon which the star washers will be mounted (FIG. 1).

Front View

33) Outer port radius

54) Central intake/exhaust ports

55) Tabbed shaft hub

71) Bumps (12)

72) 0° tab position

73) 120° tab position

74) 240° tab position

Side View

76) Outer bump radius

77) 45° bump projection

78) Inner bump radius

79) Bump height (equal to star washer width)

80) Star Washer

81) Compression/Power Disk Front View

82) Compression/Power Disk Side View

Figure 15:
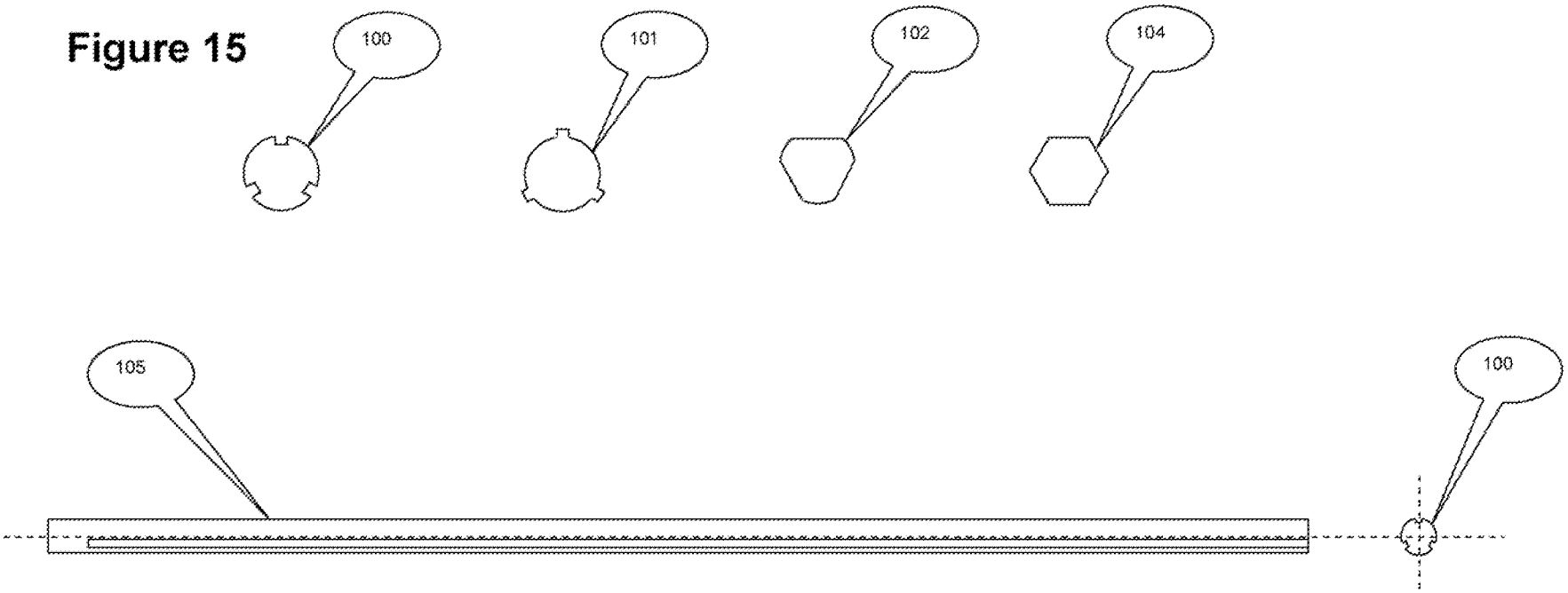

The inner layer of bumps are positioned every 90° while the bumps in the outer layer are positioned every 45° with the 0° position being the one where the tab aligns with the bumps (top vertical position). This arrangement of bumps and tabs will insure that adjacent disks when rotated 120° (to the next tab position) will have bumps rotated to nonaligned positions. Three tabs provide three positions in this example and so a disk stack will be arranged in repeating groups of three disks. Other tab and bump arrangements are possible and may be desirable depending on performance and cost (FIG. 15).

FIG. 9

Details of a Compression Disk

The primary difference between power and compression disks is size, the compression disks are larger. The relative locations of the compression disks are before (relative to air flow) the power disks (FIG. 2• 15 & 22). The compression disk is made with a smooth thin stainless material which can be stamped from a roll of material of the desired thickness; for this discussion I will assume a 0.030 inch disk thickness. Each compression disk will have the same construction. The compression disks have a front and rear side which is determined by the protrusion of bumps (front) and upon which the star washers will be mounted (FIG. 2).

Feature callouts are the same as FIG. 8.

The inner layer of bumps are positioned every 90° while the bumps in the outer layer are positioned every 45° with the 0° position being the one where the tab aligns with the bumps (top vertical position). This arrangement of bumps and tabs will insure that adjacent disks when rotated 120° (to the next tab position) will have bumps rotated to nonaligned positions. Three tabs provide three positions in this example and so a disk stack will be arranged in repeating groups of three disks. Other tab and bump arrangements are possible and may be desirable depending on performance and cost (FIG. 15).

FIG. 10

Details of a Flat Shaft Mounted Baffle Disk

The purpose of baffle disks is to redirect the working fluid flow either into the chassis center through the disk stack central ports or out toward the disk periphery. The primary difference between compression or power disks and the shaft mounted baffle disks is the lack of concentric porting. The shaft mounted baffle disk is typically the same size as the compression disks and is typically located at the rear of a compression disks assembly (FIGS. 2-17 & 24). The baffle disk is made with a smooth thin stainless material which can be stamped from a roll of material of the desired thickness. Shaft mounted baffle disks have the same construction as shown below. The shaft mounted baffle disk has a front and rear side which is determined by the protrusion of bumps (front) and upon which the star washers will be mounted (FIG. 2). The function of the shaft mounted baffle disks is to change the (36) direction of the working fluid toward the disk stack periphery.

Feature callouts are the same as FIG. 8.

The inner layer of bumps are positioned every 90° while the bumps in the outer layer are positioned every 45° with the 0° position being the one where the tab aligns with the bumps (top vertical position). This arrangement of bumps and tabs will insure that with adjacent disks rotated 120° (to the next tab position) bumps will be rotated to nonaligned positions. Three tabs provide three positions in this example and thus a disk stack will be arranged in repeating groups of three. Other tab and bump arrangements are possible and may be desirable depending on performance and cost (FIG. 15).

FIG. 11

Details of a Flat Chassis Mounted Baffle Disk

The purpose of baffle disks is to redirect the working fluid flow either into the chassis center through the disk stack central ports or into the concentric ports. The primary difference between a shaft mounted baffle disk and a chassis mounted baffle disk is that there is no provision for shaft mounting or spacing bumps for this disk as shown.

Chassis mounted baffle disks are typically larger than either compression or power disks and is typically the diameter of the chassis. The (19) chassis mounted baffle disk is typically located at the rear of a power disk assembly. These disks are replaced by labyrinth seal pairs (FIG. 14) which form the rear of the chassis in a modular chassis arrangement. Otherwise the chassis mounted baffle disk orifice is the same size as the (33) outer port aperture and is typically located at the rear of a power/exhaust disk assembly. The baffle disk is made with a smooth thin stainless material which can be stamped from a roll of material of the desired thickness. Each chassis mounted baffle disk will have the same construction. The chassis mounted baffle is featureless (FIGS. 2-19 & 26).

83) Front View

84) Outer port diameter

85) Side View

The large circular hole in the disk center is the same size as the outer periphery of the port opening and allows the working fluid to exit the previous stage and enter the next. The function of these chassis mounted baffle disks are similar to the shaft mounted versions in that they change the direction of the working fluid which in this case is (42) directed through the center ports.

FIG. 12

Shaft Mounted Male Labyrinth Seal

The Shaft Mounted Male Labyrinth Seal is a smooth (polished) solid stainless steel or other non-corrosive material that has a good resistance to deformity at high combustion temperatures and high speed centrifugal forces. The male labyrinth seal will provide a leak proof non-contact barrier between the outer and inner chassis (exterior and chassis chamber). The diameter of the male labyrinth seal should be the same or greater than the engines compression disks. This male labyrinth seal will feature a set of concentric cylinders raised perpendicularly from the disk surface which will fit without contact into a complimentary female fixed labyrinth seal that will be mounted to the chassis front and rear. The front and rear male labyrinth seals are identical where both seals are turned to a 120° tab position so as not to interfere with the bump pattern of their adjacent disks. Both disks will use a star washer mounted on the bump pattern (front) side. The male labyrinth seal will be balanced for optimal high speed operation.

86) Front Shaft Mount View
87) Concentric ring height
88) Front View
33) Outer port radius
54) Central intake/exhaust ports
55) Tabbed shaft hub
71) Bumps (12)
89) Front Mount View
90) Concentric rings
91) Rear Shaft Mount View
92) Concentric seal rings radius
80) Star Washer

FIG. 13

Figure 13A:
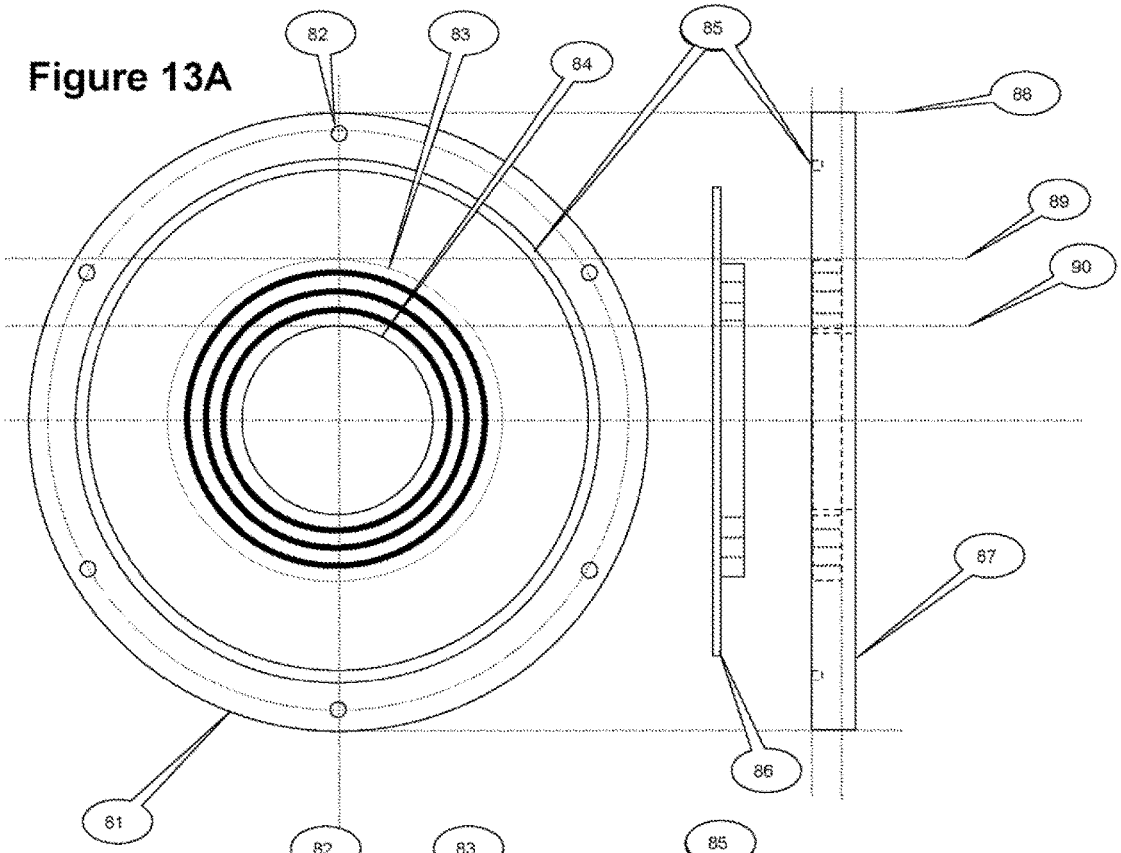

FIG. 13A—Ported Chassis Mounted Female Labyrinth Seal

Figure 9:
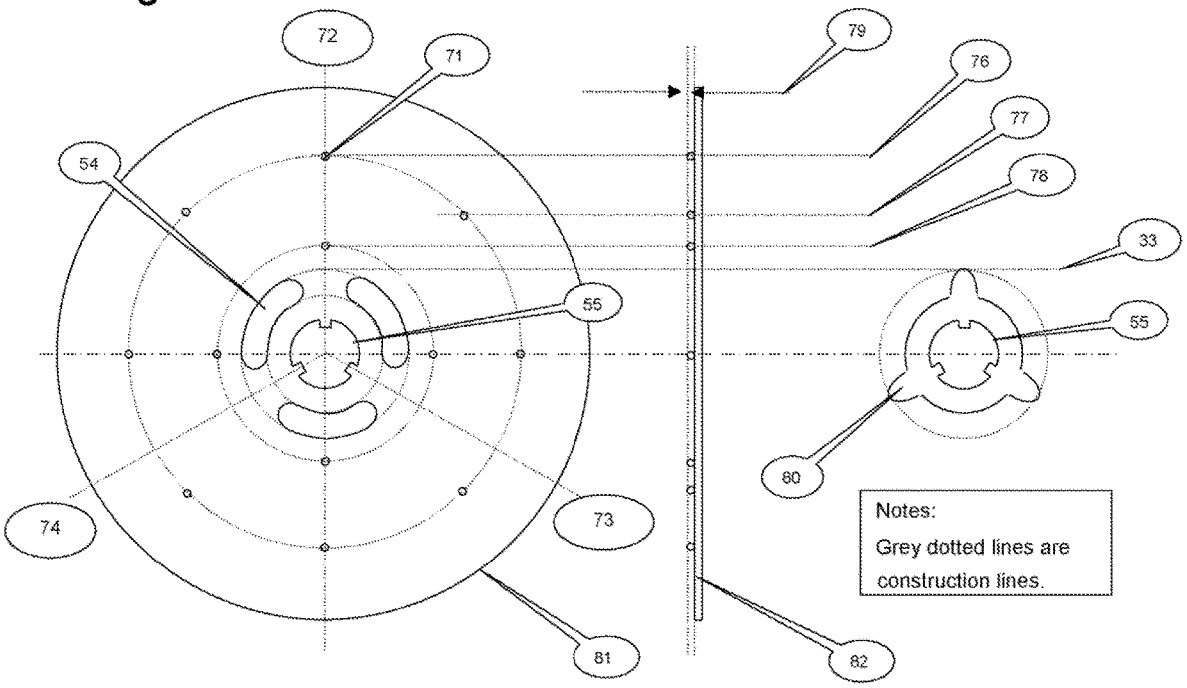
Figure 10:
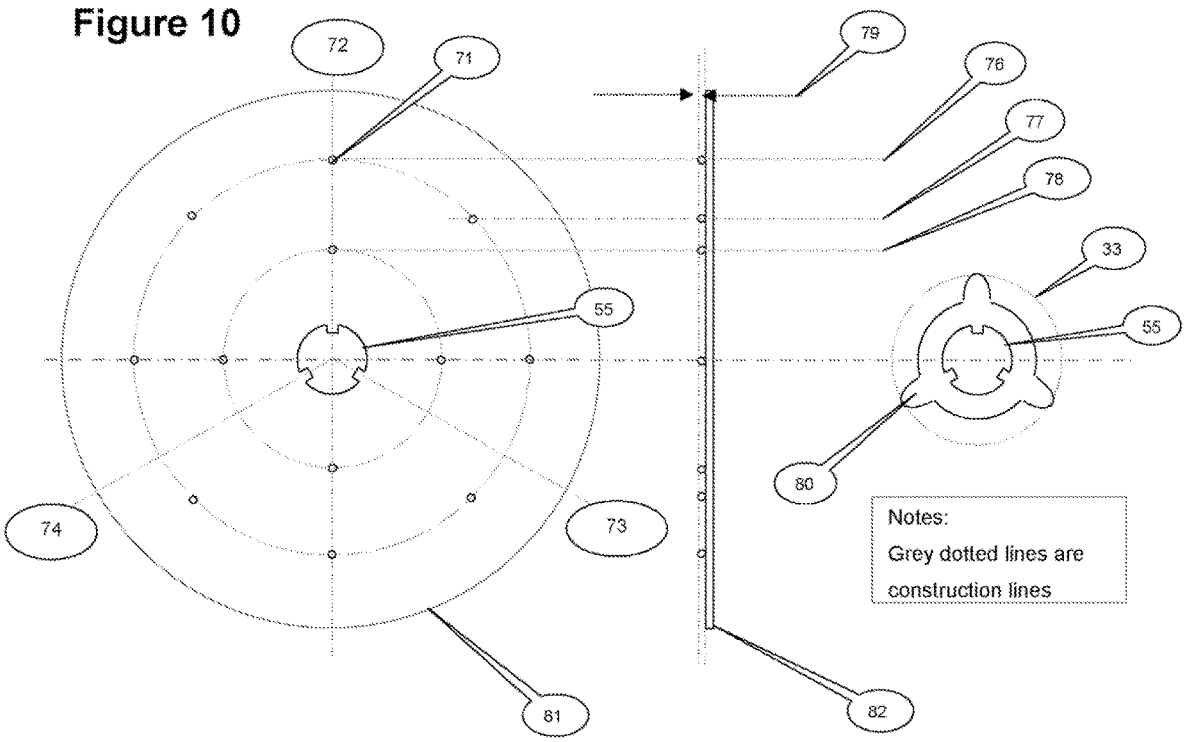
Figure 11:
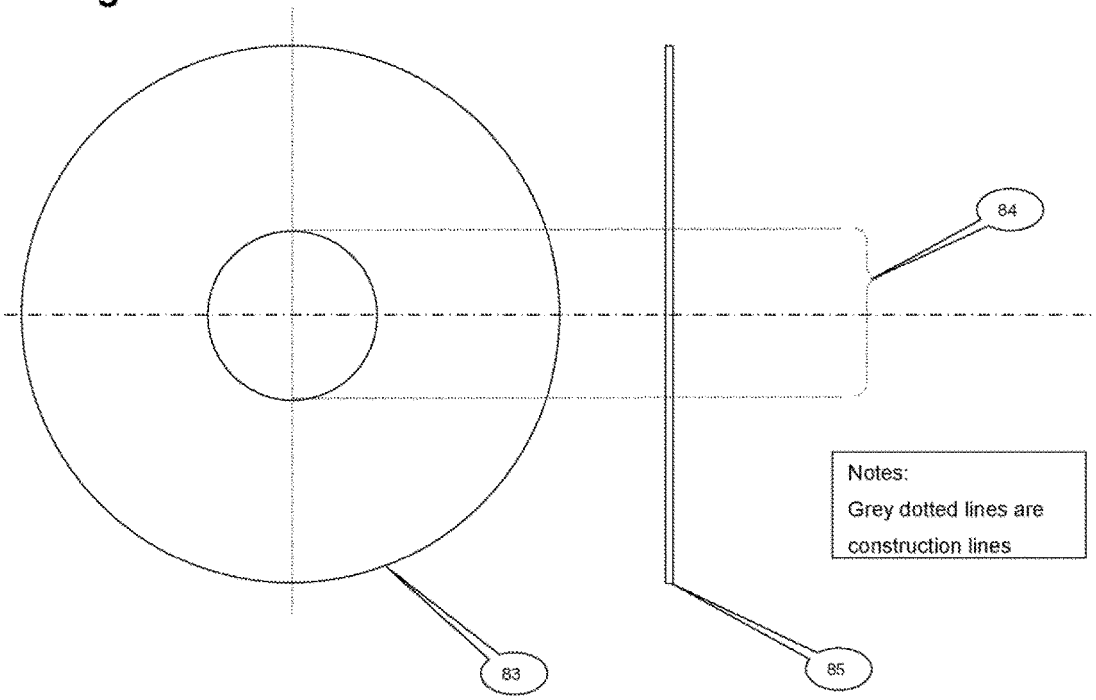
Figure 12:
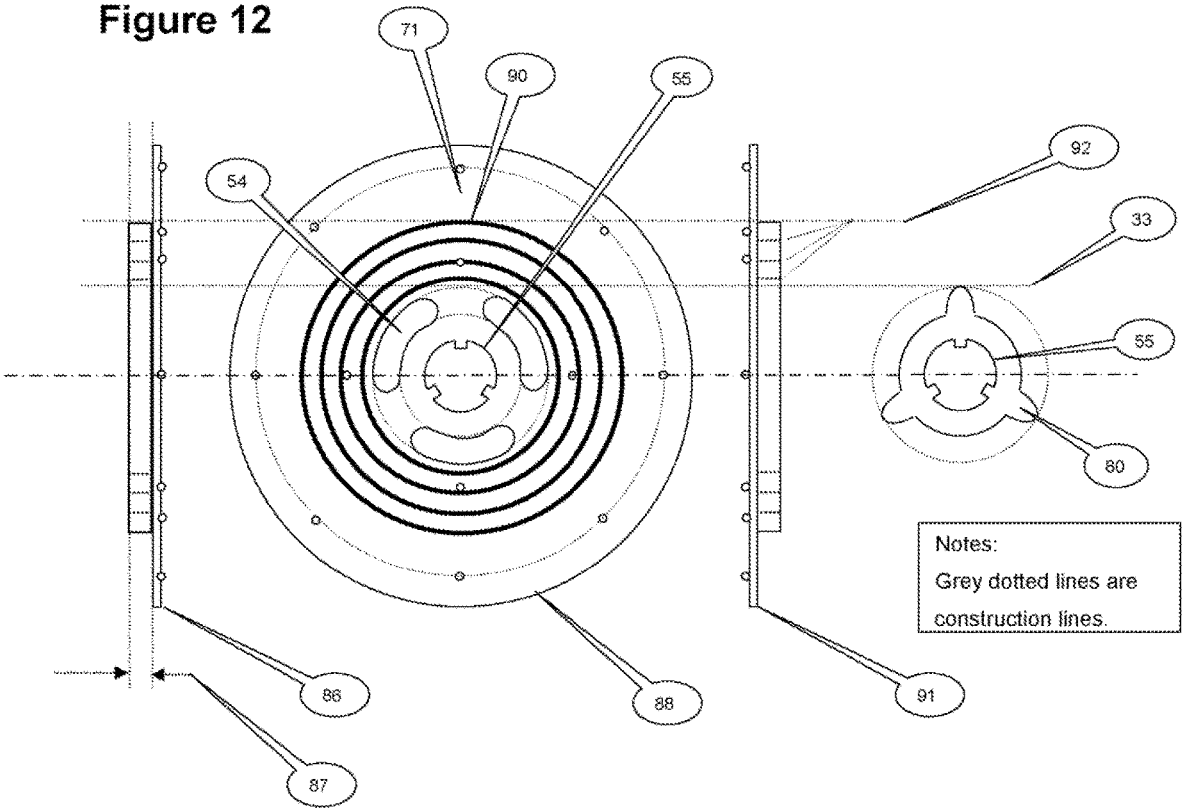

The Chassis Mounted Ported Female Labyrinth Seal is a smooth (polished) solid stainless steel or other noncorrosive material that has a good resistance to deformity at high combustion temperatures. The female labyrinth seal will provide a leak proof non-contact barrier between the outer and inner chassis {exterior and chassis chamber). The diameter of the female labyrinth seal should be the same as or greater than the male labyrinth seal. The female labyrinth seal surface will feature a set of concentric cylinders indented perpendicularly from the disk surface which will accommodate, without contact, a complimentary male shaft mounted labyrinth seal. Male and female labyrinth seal sets are mounted to the front and rear of the engine (FIGS. 16-9 & 10). The front and rear female labyrinth seals are identical. The female labyrinth seal will be sized to provide a close non-contacting fit when the engine is operating in either a hot or cold mode.

Figure 13B:
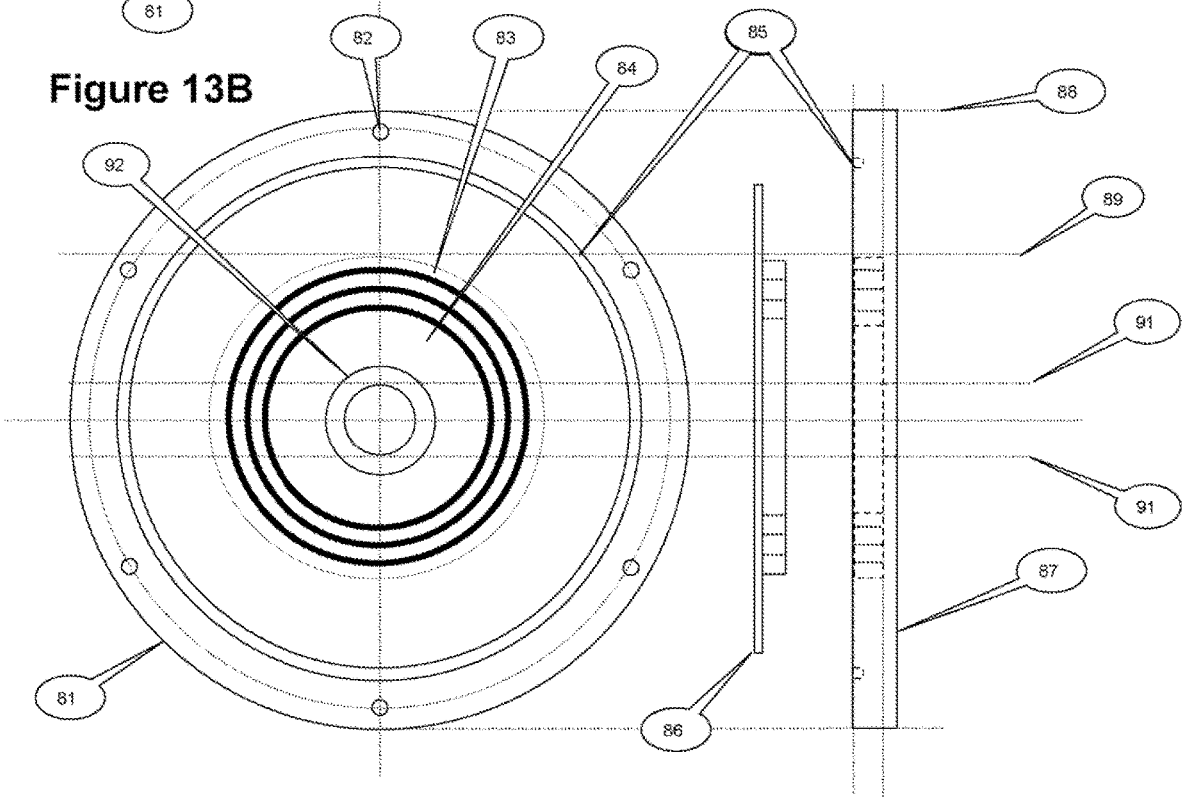

81) Front view of female labyrinth seal
82) Holes for fastening chassis end plates to the chassis body
83) Labyrinth trough
84) Center orifice
85) Trough to accommodate chassis cylinder end
86) Side view of mating male labyrinth seal
87) Side view of female labyrinth seal
88) End-labyrinth seal radius
89) Labyrinth configuration radius
90) Outer port radius FIG. 13B—Portless (non-ported) Chassis Mounted Female Labyrinth Seal.

The Chassis Mounted Port-less Female Labyrinth Seal is a smooth (polished) solid stainless steel or other noncorrosive material that has a good resistance to deformity at high combustion temperatures. The female labyrinth seal will provide a leak proof non-contact barrier between the outer and inner chassis (exterior and chassis chamber). The diameter of the female labyrinth seal should be the same as or greater than the male labyrinth seal. The female labyrinth seal surface will feature a set of concentric cylinders indented perpendicularly from the disk surface which will accommodate, without contact, a complimentary male shaft mounted labyrinth seal. Male and female labyrinth seal sets are mounted to the front and rear of the engine (FIGS. 16-9 & 10). The front and rear female labyrinth seals are identical. The female labyrinth seal will be sized to provide a close non-contacting fit when the engine is operating in either a hot or cold mode.

91) Shaft aperture radius
92) Bearing recess

Other feature callouts are the same as FIG. 13A.

In the illustration shown here and below, the female labyrinth is incorporated into the front or rear walls of the chassis covers.

FIG. 14 Labyrinth Seal Schematic and Labyrinth Seal Detail (Side View)

93) Labyrinth seal schematic
94) Female labyrinth seal schematic
95) Male labyrinth seal schematic
96) Labyrinth Seal Female (chassis mount)
97) Labyrinth Seal Male (shaft mount)
98) Labyrinth Seal Mating
99) Labyrinth Seal Mating Detail FIG. 15—End View of Shaft Types Shaft Construction:

The shaft is a smooth (polished) stiff solid stainless steel or other noncorrosive material that has a good resistance to deformity at high combustion temperatures and high speed centrifugal forces. The diameter of the shaft is determined by its desired speed and torque output. The shaft will feature a balanced slot (2, 3 or 4 slots) arrangement to accommodate the disk and star washer tabs that will be mounted onto it. Bearing mounts will secure the shaft to the chassis stage (or stages) and will be supplemented by a lubrication system that will also provide some degree of cooling. The shaft will be balanced for optimal high speed operation.

Figures 16A, 16B:
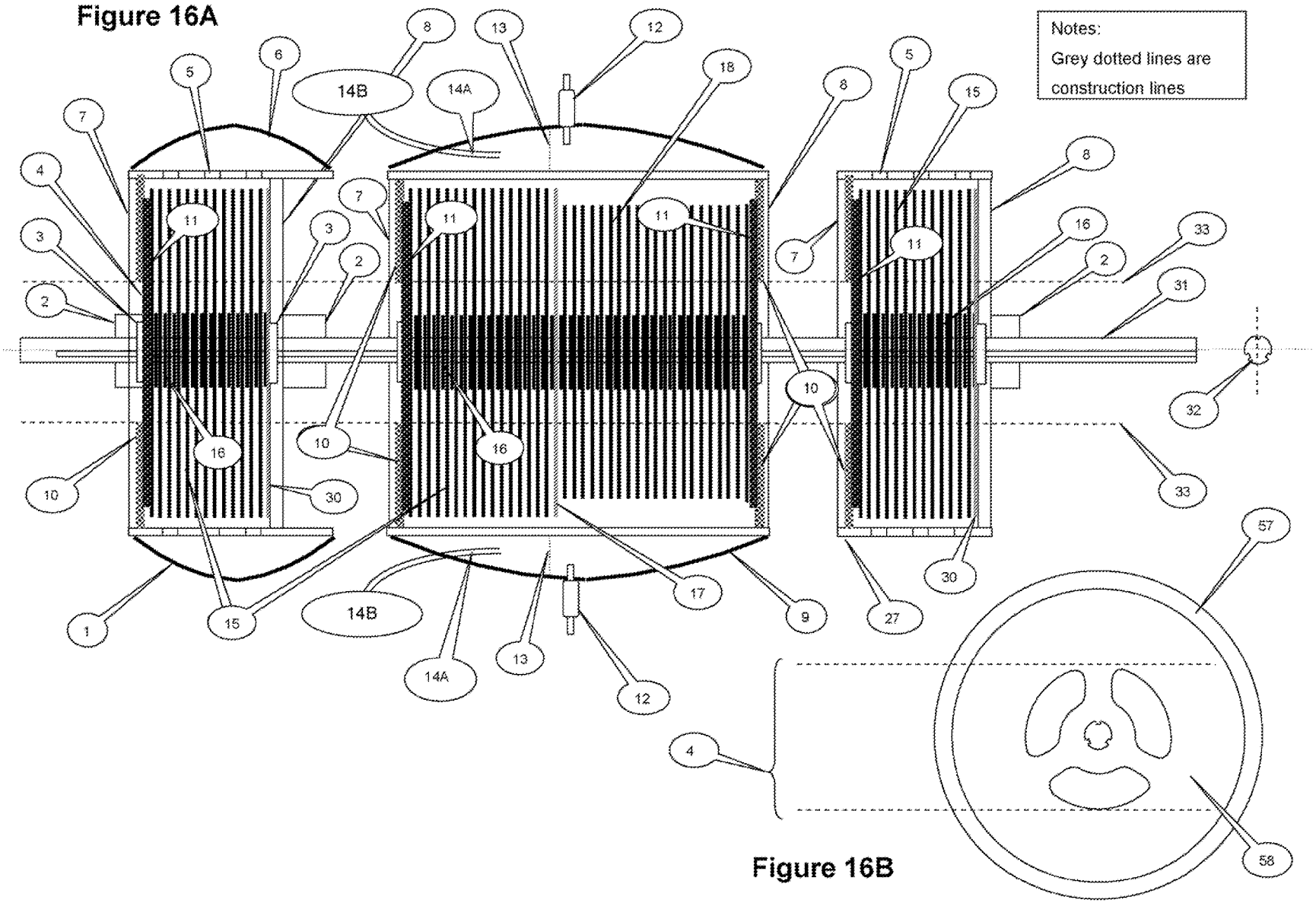

100) Slotted shaft end view
101) Tabbed shaft end view
102) Triangular shaft end view
103) Hexagon shaft end view
104) Shaft Detail FIG. 16—Compound BI TE Construction Description:

FIG. 16A—Schematic Diagram of a Compound Internal Combustion BL TE with Single and Auxiliary Stages (Side View)

1) Chassis (also see Cylinder Chassis)
2) Bearing Housings
3) Frictionless Bearings
4) Intake Ports
5) Exhaust Ports
6) Pre-Compression Auxiliary Chassis
7) Chassis Cover (ported)
8) Chassis Cover (port-less)
9) Main Stage
10) Front Female Labyrinth Seal
11) Front Male Labyrinth Seal
12) Igniter
13) Flame Barrier
14A) Fuel Injector
14B) Fuel Reservoir
15) Compression Disk Stack
16) Star Washers
17) Shaft Mounted Baffle Disk
18) Exhaust/Power Disk Stack
11) Rear Male Labyrinth Seal
10) Rear Female Labyrinth Seal
27) Post Exhaust/Evacuation Auxiliary Stage
2) Bearing Housings
3) Frictionless Bearings
4) Intake Ports

5) Exhaust Ports
7) Chassis Cover (ported)
8) Chassis Cover (port-less)
15) Exhaust/Evacuation Disk Stack
16) Star Washers
17) Shaft mounted baffle disk
30) Shaft mounted baffle disk
31) Shaft
32) Shaft end view (slotted)
33) Outer port radius FIG. 16B—Front View of Power Disk {front) and a Compression Disk {rear) This diagram illustrates the relative sizes of the compression and the power disks.

4) Intake Port Diameter (Outer Port Diameter)
57) Compression disk
58) Power disk (larger of the power disks)

Note: Shaft mounted components, fuel and ignition components serve the same functions as explained in the Complex BL TE Diagram (FIG. 2).

Figure 17:
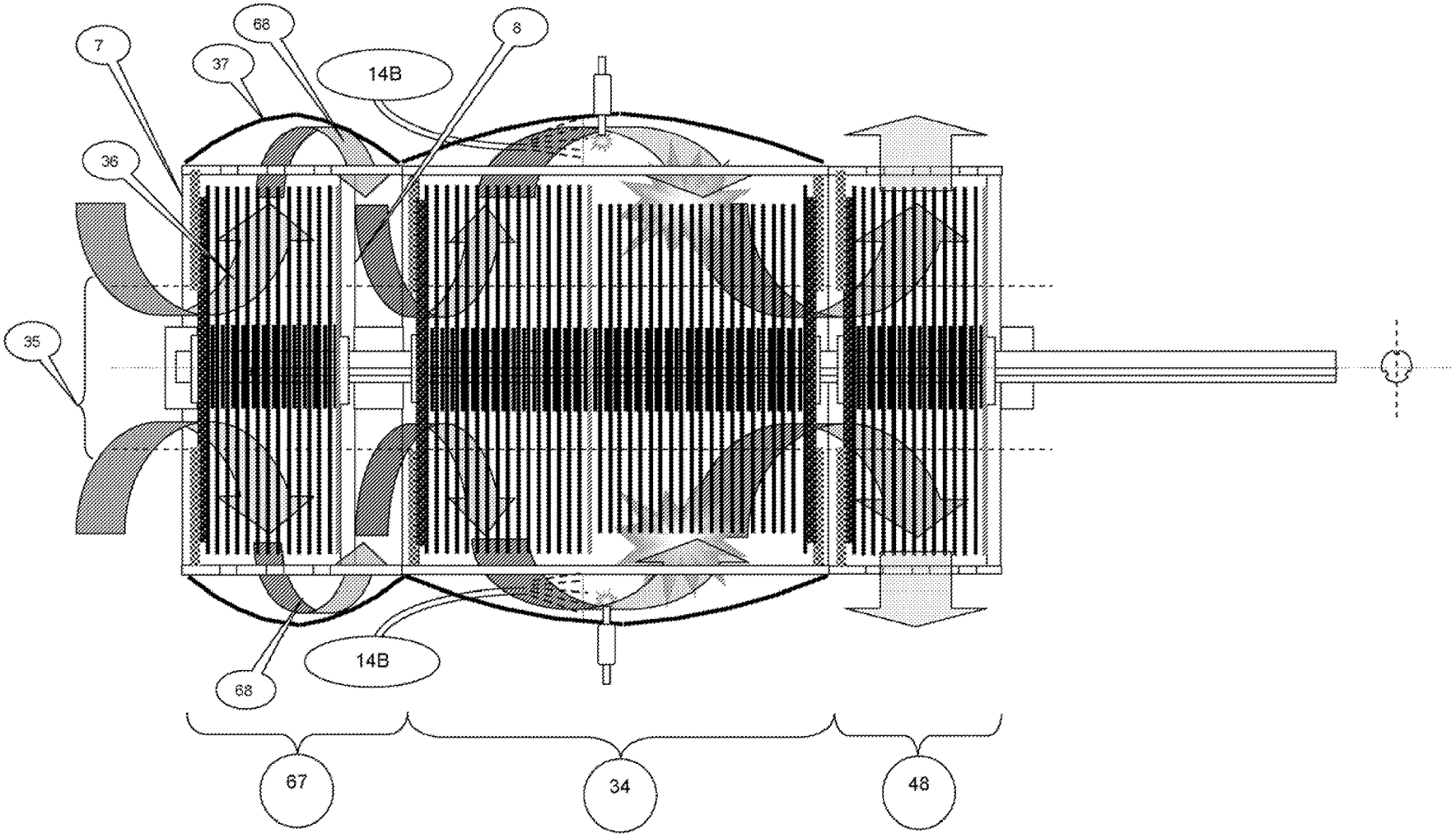

FIG. 17—Compound BLTE Operation Diagram

Schematic Operation of a Compound Internal Combustion BL TE with Single Main and Auxiliary Stages (Side View)

7) Chassis Cover (ported)
8) Chassis Cover (port-less)
14B) Fuel Reservoir
67) Pre-Compression Auxiliary Stage
68) Compressed airflow to Main Stage intake
35) Air Intake Compressor Intake Ports
36) Air Compression
37) Pre-Compression Auxiliary Chassis
34) BL TE Main stage
48) Post-Evacuation/Exhaust Auxiliary Stage The Main Stage and the Exhaust/Evacuation Stage operates as explained in FIG. 7.

Figure 18:
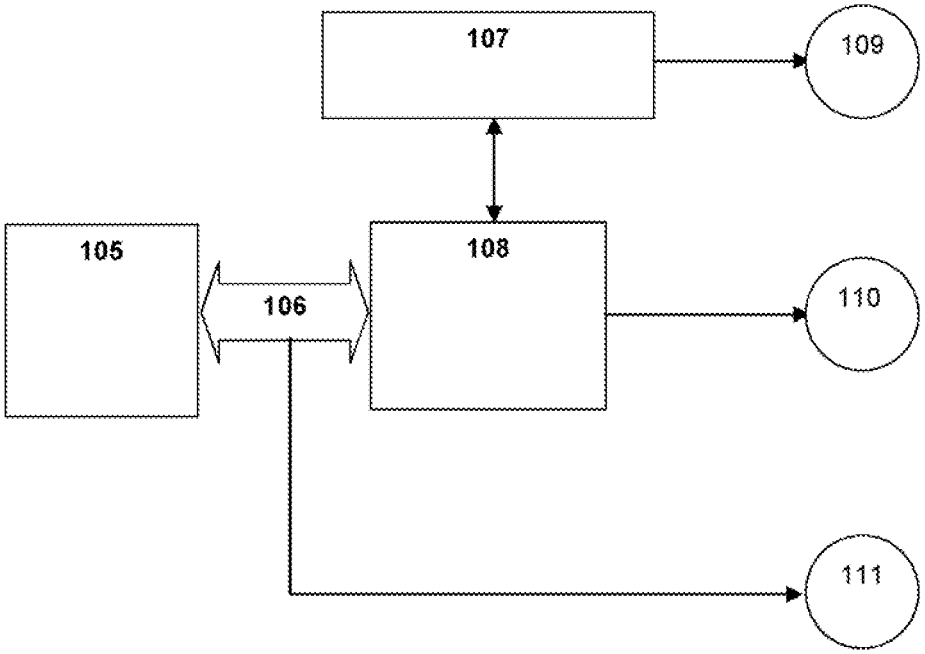

FIG. 18—BL TE System Configuration

Figure 19:
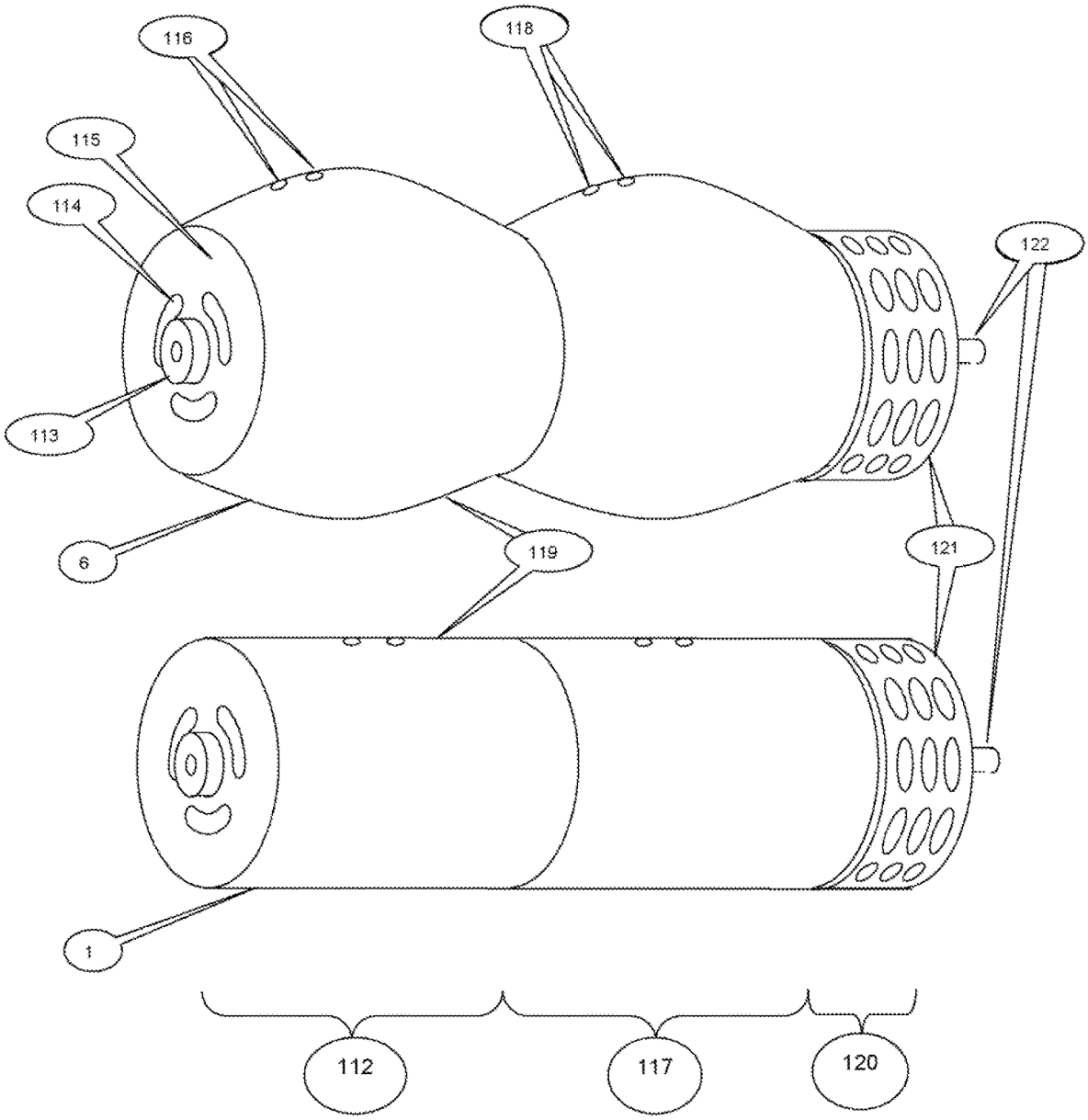

105) BLTE
106) Mechanical Link
107) Battery Bank
108) Variable Frequency High Power Electric Converter
109) Direct current Applications
Battery replacement
Electrical power generation
Electrical auxiliary generation
Personal power sources
110) Alternating Current Applications
Marine motor
Aircraft motor
Mechanical auxiliary power
111) Possible Mechanical Link to Gear box FIG. 19—Chassis Diagram:

The BL TE chassis is a pressure vessel which supports fuel/water/air injection, ignition, bearing support, lubrication, intake and exhaust. The chassis will also support instrumentation for measuring disk speed, intake flow, combustion temperature, combustion pressure, stage 2 flow (if populated with a second stage), chassis temperature, pressure, exhaust flow and temperature. The material from which the chassis is constructed must withstand high temperature and medium pressure. The interior of the chassis will be machined with a surface which provides the least amount of drag to the working fluid vortex contained within.

1) Cylindrical Chassis
6) Bubble BL TE Chassis
112) Main Stage 1
113) Shaft Bearing Cover (before and after each compound stage)
114) Air Intake Centrifuge/Intake Ports
115) Front Cover
116) Fuel Injection & Ignition Ports Combustion, Power Flow & Exhaust
117) Main Stage 2
118) Water/Air/Fuel Injection & Ignition Ports
119) Containment Jackets
120) Post Exhaust/Evacuation Auxiliary Stage (optional)
121) Exhaust Ports
122) Shaft (output coupling)

Note: The Cylindrical BL TE Chassis has analogous features to the Bubble BL TE Chassis.

SUMMARY OF THE INVENTION

This invention relates to a high speed radial flow turbine engine which operates on a multitude of fuels and can replace all reciprocating and radial turbine applications and more. This application can be configured as a single or multi-staged modification of a previous external combustion design.

This engine is composed of the following:

Stage Description: (FIG. 8 through 14) five types of flat disks typically with (54) center ports. An (FIG. 14A) intake seal disk which incorporates a seal mechanism that with a (10) complimentary seal on the opposite case wall, prevents the escape of pressurized gasses. (15) A compressor section of disks limited by a (17) baffle disk with no center port. (41) A combustion chamber into which (14A) fuel is injected, a (13) flame barrier to maintain ignition and an (12) electrical igniter (or other igniter type) by .which (41) combustion is initiated and (FIG. 8) a series of ported disks which extract the energy of combustion and exhaust the working gasses (fluid) via the center ports. (20) Additional stages are only limited by the availability of (44) working fluid heat, available expandables and/or combustibles. (43) Additional stages will enhance engine power and/or efficiency.

Auxiliary Stages: (67) An additional pre-stage(s) can be concatenated to the above described BL TE (34) Main Stage(s) with the additional capability of (36) air compression. (68) The additional post-stages evacuate or redirect the working fluid stream.

All components described previously in terms of a (9) "stage" are necessary for the operation of this engine. Multiple stages (FIG. 2) are optional, other (21A) expansion gasses are optional, the (31) variable speed shaft is optional and in lieu of a mechanically geared output the (108) high-speed electrical generator output device is optional. Any of the optional devices would improve the operation of this engine. The addition of an electronic engine controller module (ECM) would greatly augment engine operation and enhance applications.

Simple and standard manufacturing tools are necessary to produce the BL TE which is one of the main points of its desirability. Otherwise, centering and balancing tools with high-speed and high-temperature bearings are necessary for correct operation. Such devices are commonly used in the production of standard turbine engines and turbo compressors for reciprocating engines.

The relative sizes of the (15) compression disks to the (18) smaller but more numerous power disks as shown (FIG. 2) are primarily responsible for the working fluid flow along "the path of least resistance" which is essential for engine operation.

All disks are positioned on a (31) single shaft (the shaft may incorporate variable speed sections) where the (15) compressor disks provide (36) air intake into the (41) combustion/expansion chamber. The baffle disk(s) define the boundaries of the (17) compression functions, (19) power functions and confines the BL TE sub-stages. The (18) exhaust disks extract energy from the (42) working fluid (combustion gasses) and exhaust those gasses through the (54) center ports to the (20) next stage if any.

As the disk assembly is rotated, air is (36) inducted and compressed due to disk surface drag and its centrifugal forces. After (41) combustion and (42) expansion the combusted gas (working fluid) is exhausted through and across the exhaust disks and ultimately out of the center ports. The forcing of the working fluid in a (42) decreasing radius through to the center ports of the exhaust disk array extracts the energy of the combusted gasses and delivers that energy to the (33) center shaft (drive shaft).

Other boundary layer turbine engines are implemented as single-stage, single disk stack devices using singular disk sizes and types that are typically powered from an external combustion source. This invention incorporates internal combustion in a (34) single main stage which may also be arranged in (43) multi□stages where each stage may provide (36) intake, compression, combustion or (46) expansion and (47) exhaust with a single moving disk assembly imposing efficiency of the working fluid flow. The working fluid flow through the BL TE is called the "respiration" cycle.

This invention incorporates multi-stages arranged as complex (single chassis stages—FIG. 3) or compound (multiple chassis stages FIG. 7) where a single stage provides intake, compression, combustion and exhaust with a single moving part and relatively low working fluid flow. The advantage of a modular approach is modification for various applications.

This invention can be used in place of any reciprocating engine application (automotive, airspace, marine, power tools, and as a replacement for many battery applications).

DETAILED DESCRIPTION OF THE PREFERRED EMBODIMENT this Boundary Layer Turbine Engine (BL TE) product is a continuous-burn internal-combustion high efficiency converter of hydrocarbon fuels to kinetic energy. This engine design is based on the Tesla turbine 1 flat bladed external combustion engine but has been modified with intake, compression, combustion and exhaust components which will form a basic main BL TE "stage". Auxiliary (optional) stages can be used as additional (1) pre-compression or post-combustion (exhaust/evacuation) stages to enhance engine performance. The difference between the auxiliary compression and exhaust stages will be the relative placement of these stages to the working fluid flow in a compound (multi-stage) or complex (single chassis) engine arrangement.

This invention, the Boundary Layer Turbine Engine (BL TE), is a flat disk (bladeless) turbine that operates on the principal of "aerodynamic drag". Multiple disks with aligned center ports, closely arranged in a stack (FIG. 1) will take advantage of the energy of a (36) working fluid forced into a chassis at the outer perimeter of a compression disk stack. Control of the BL TE speed or power output is done by metering (38) fuel and/or air into the BL TE Chassis. After (41) combustion, this fluid flow will impart its energy to the {42) exhaust/power disks as it is forced to spiral its way towards and out of their center ports. The method of this energy exchange is by virtue of the working fluid's viscosity that attaches (drags) it to the contours of the disk faces and by virtue of the decreasing radius of its path, resulting in the decreasing speed of the working fluid flow which converts the reduced working fluid speed to increased torque applied to the center shaft (31). This engine is essentially a radial flow turbine that takes advantage of the close fittings of its bladeless disks and chassis walls to provide high compression and an especially low working fluid flow as compared to fan-bladed and/or vane-disk radial flow turbines.

This particular application solves the problem of internal combustion and multi-stage operation (FIG. 7) for this type of engine.

This invention provides internal combustion in both single chassis (complex-FIG. 3) and multi-chassis {compound-FIG. 7) configurations. The BLTE design allows the (41) combustion of fuel in the first stage and the {46) injection of either water to provide steam expansion, air to provide air expansion or fuel into a second stage providing an afterburning effect to boost the power output.

This invention provides scalable power (high, medium or low) output configurations, and provides these outputs at approximately three times the efficiency of a reciprocating engine and at a higher efficiency than a conventional radial turbine engine. The physical scalability ranges from battery replacement applications (coin-size) to maritime applications (yards across), where the intention is the replacement of reciprocating (piston driven) engines and much more.

BL TE Operation: Conventional radial and axial flow turbine engines employ vanes arranged at inclined angles on the disk peripheries which necessarily separate the disks by the vane depth. This arrangement demands a high velocity flow which wastes a tremendous amount of heat energy and employs expensive turbine vane construction to withstand centrifugal forces at high exhaust temperatures. The BL TE has no vanes and employs solid disk construction that inherently resists centrifugal deformity at exhaust temperatures and may be arranged (stacked) in a close fashion that will reduce working fluid flow while increasing working fluid pressure.

The BL TE is a superior radial turbine engine due to its miserly working fluid flow through {47) closely spaced flat disks. The flat disks allows exhaust currents of different energy levels to proceed along their own paths insuring greater efficiency and a wider operating range (engine speed) than conventional vane turbine engines. When compared to reciprocating {piston driven) engines, the incredible efficiency gain is due to the lack of internal friction arising from pistons sliding on cylinder walls, valve trains, system pumps and especially the parasitic sapping of heat removed by the cooling system from a heat driven engine; the analog of cooling (heat removal) is the use of a deflector to divert wind from the sails of a wind driven vessel.

Aerodynamic Drag: The BL TE Internal Combustion Radial Turbine Engine operates on the principal of the aerodynamic drag 5 of air/working fluid adhered to the disk surfaces and the vortex dynamics due to disk rotation. The Tesla Turbine Engine 1 configuration was originally conceived as an external combustion (steam driven) engine. A variation of the Tesla engine has long been used in industry as centrifugal pumps 2.

Disk Pumping Action: Each set of disk stacks attached to the turbine shaft will naturally act as a centrifugal pump. When rotated, each disk stack (FIG. 3) of all stages (36) accelerates the fluid attached to its disk surface in a vortex pattern to the disk periphery. This action in an enclosed space will produce a pressure which is proportional to the disk surface drag, the disk radius and the disk stack speed. In FIG. 2 the larger (15) compression disks will produce a higher pressure/flow than the smaller (18)

power/exhaust disks such that even without combustion, the turning of the (FIG. 6) disk assembly within an enclosure will cause a natural flow of air from the front (intake—35) to rear (exhaust—48) of the engine.

Fueling: The BL TE is fuel insensitive, as is the case with most turbine engines and may be run on multi-grade diesel, bio-diesel, multi-grade gasoline, alcohols, natural gas, etcetera without significant change of hardware. Fuel injection (38) and an ignition source (40) will produce combustion (41) which will boost the pressure above the power/exhaust disks and exhausting through the power/exhaust disks to their central ports following the "path of least resistance".

Exhaust and Power Output: The spiraling combustion products (working fluid) exiting across the power/exhaust disks imparts its energy to those disks by virtue of their decreasing radius imparting the working fluids decreasing angular momentum until it exits the center ports, this in turn driving the shaft, the forward compression disks and any other disk assemblies or external loads attached to the shaft.

Second Stage Power Augmentation: The (22) compression disk stack of the second engine stage will serve to (43) evacuate the first stage (34) exhaust and help with insuring the direction of working fluid flow. Into this stage it would be possible to (45) inject outside air, the expansion of which in the (44) hot exhaust stream would provide additional drive to the system as it exits across the (47) power/exhaust disks of the second stage. Alternatively, an injection of water spray into the hot exhaust stream would be flashed into (46) steam the expansion of which driven across the second stage power/exhaust disks could also provide additional torque. The greatest auxiliary drive power source would be the result of (45) injecting fuel (perhaps with an auxiliary ignition source) into the hot exhaust stream in an after-burn fashion for torque extraction across the power/exhaust disks.

Auxiliary Stage Augmentation: The addition of augmenting stages for (67) compression or (48) exhaust enhancement (FIGS. 16A & 168) can be used to either increase compression or to evacuate exhaust. Auxiliary or supplementary stages will serve to optimize compatibility of the BL TE for a particular application.

BLTE DYNAMICS: A BLTE stage consists of a set of large disks which will act as an intake (15) compressor and is separated from the rear part of the stage by a baffle (17) disk. The rear portion of a BLTE stage has a smaller {18) disk set from which it extracts the energy from the internal combustion process and applies that energy to the (31) shaft.

The rotation of the shaft mounted disk assembly accelerates the working fluid in the first stage through the intake ducts (36) and forms a vortex which is expanded for (38) fuel injection and (41) combustion. The hot (41) working fluid vortex is exhausted through the power/exhaust disk assembly and out of the first stage exhaust ports (42).

All disks are positioned on a single shaft (the shaft may incorporate variable speeds) (31) where the (15) compressor disks provide air intake and compression into the combustion/expansion chamber. The exhaust disks (42) extract energy from the working fluid (combustion gasses) and exhaust those gasses through the center ports (44) to the next stage if any.

No parts of the disk assembly come into contact with the chassis except the bearing surfaces which support the (3) shaft and disk assembly.

All components described previously in terms of the (9) "1st stage" are necessary for the operation of this engine and are, in essence, a stand alone BL TE stage. Multiple stages of FIGS. 7 (34, 43, and 48) are optional, other (FIG. 16) compression or expansion auxiliary stages are optional, the variable speed shaft is optional and the electrical generator output device is optional in lieu of a geared output. Any if not all of the optional devices would improve the operation of the BL TE. The addition of an electronic engine controller (ECM) represented in FIG. 18 would greatly enhance engine efficiency, operation and applicability.

Simple and standard manufacturing tools are all that is necessary to produce the BL TE which is one the main aspects of its desirability. The resistance of the BL TE (FIG. 8) disk construction to high temperature deformity means reduced costs of materials, elimination of expensive noble metals and single-crystal grown, hollow (cooled) turbine blades which are characteristic of conventional turbines. Otherwise centering and balancing tools with high speed and high temperature frictionless (pneumatic, oil or magnetic) bearings are necessary for correct operation. Such devices are commonly used in the production of conventional turbine engines and/or turbo compressors for reciprocating engines.

The individual stages as described previously may be operated in series to increase working fluid pressure or in parallel to increase working fluid flow. In FIG. 16 the (1) compressor stages may be ganged before introduction of the compressed air into the (9) primary stage combustion chamber and an exhaust evacuation stage may follow any stage to (27) evacuate combustion gases from primary stage(s).

The operation of either the Complex or Compound BL TE is similar regardless of the minor differences in construction. The primary difference between the Complex or Compound BL TE is that all main stages and auxiliary stages of the Complex BL TE are housed in a single chassis. For the Compound BL TE, all main stages or auxiliary stages are housed in separate chassis that may be concatenated or ganged for appreciation of various engine characteristics related to different applications.

Disk Construction and Assembly:

As shown in FIGS. 8 through 14 there are basically five types of disks which depending on their relative positions perform various functions. There are also (71) disk bump features and (80) star washers which maintain disk separation. All of the disks described herein are smooth (polished) stainless steel or other noncorrosive materials that have a good resistance to deformity at high combustion temperatures and high speed centrifugal forces. Each shaft mounted disk will have tabs positioned around the shaft opening that will allow mounting onto the center shaft. Various shaft configurations are shown in the Shaft Construction section. Each shaft mounted component will be balanced for high speed operation.

These disk types are:

1. A front or rear (FIG. 13) chassis mounted disk with features making the female (receiving) side of the labyrinth seal (10).
2. A front or rear (FIG. 12) shaft mounted disk with features composing the male (protruding) side of the labyrinth seal (11).
3. Star Washers (80)
4. The (FIG. 9) Compression Disk which can be larger than the labyrinth disks and is larger than the (FIG. 8) power disks. This disk is (55) shaft mounted and has a (54) port arrangement that is concentric to the shaft. A (80) star washer is mounted forward of these disks.

A (71) bump configuration is constructed with the same height as the width of the (80) star washers to maintain disk spacing.

5. The (FIG. 10) Compression Baffle is a (55) shaft mounted disk with no concentric porting, whose use is to terminate the compression sub-stage and conduct the working fluid to the fuel injection and combustion locations at the disk stack periphery.
6. The (FIG. 8) Power Disks are (55) shaft mounted and have a (54) port arrangement that is concentric to the shaft. These disks are arranged as a stack of disks which determine engine torque and speed.

A (80) star washer is mounted forward of these disks.

A (71) bump configuration is constructed with the same height as the width of the (80) star washers to maintain disk spacing.

The labyrinth seal disks are optional and may vary in size from one another. Another chassis to disk stack sealing arrangement may be simply a very close fit of the front or rear disk of a disk stack to specially channeled chassis walls.

The (FIG. 19) BL TE chassis can also have (116) threaded holes which allow water injection or instrumentation to facilitate operation. Stages (118) other than the main combustion stage may have threaded ports that allow (14A) fuel injection in an after-burn mode, water injection as an expandable working fluid medium, air or other fluids as desired. These threaded ports would be plugged when not used or populated to obtain the desired performance. The chassis may incorporate a lubrication pump and a lubrication cooling system (Chassis Construction).

Chassis Construction:

A (FIG. 19) modular (compound) BL TE is composed of multiple chassis fixed one to the other and each containing a single primary stage and/or an auxiliary stage. Compound (FIG. 7) stages will be fixed to one another by cast features such as threads, locks or bolt holes. A complex (FIG. 2) BL TE is a configuration where a single chassis contains multiple primary stages or a single primary stage and multiple auxiliary stages. The chassis is the component that will determine if the BL TE is a modular (compound) or a single (complex) engine arrangement. The chassis (FIG. 19) is basically a cylindrical pressure vessel with (113) bearing mounting features at either end of the chassis cylinder and (116 & 118) threaded ports to allow fueling and ignition. The (115) front end may either be made as a solid attachment to the cylindrical container or as a separate disk cover. The (121) rear end is a separate (13B) disk cover attachable to the cylindrical container through which the disk assembly and various other internal components may be inserted for mounting. The internal wall of the containment cylinder will have a rough finish (brushed, pitted or dimpled) to prevent working fluid adherence to it by introducing surface (minimal) turbulence. The external portion of the chassis will provide mounting points to allow the BL TE engine to be fixed to a larger external framework.

Pressure Vessel: The chassis as a pressure vessel will accommodate sealing at the front and rear of compound stages, at the front of auxiliary stages and at the front of the complex engine vessel.

Front Wall: The front wall of a compound BLTE stage will incorporate a (96) female (chassis mounted) labyrinth seal mated with a (97) male (shaft mounted) labyrinth seal. The (FIG. 2) complex BL TE stage is sealed in a similar manner using (17) shaft mounted and (19) chassis mounted baffle disks.

Rear Wall: The rear wall of a compound BL TE stage will also incorporate a (96) female (chassis mounted) labyrinth seal mated with a (97) male (shaft mounted) labyrinth seal. Each compound BL TE stage is sealed with a mating male and female labyrinth seal pair. The auxiliary (27) exhaust stage has (5) exhaust ports in the rearmost cylindrical portion of the chassis while the (8) rear wall has only an exit hole for the shaft and a bearing mount.

Chassis Mounted Baffle Disk: The (19) chassis mounted baffle disk (FIG. 2) is port-less and is used to redirect working fluid flow. (30) Shaft mounted baffle disks are mounted as the rearmost disk in the stack of any auxiliary stage to redirect the working fluid to the disk periphery and to impede the working fluid from escaping in an undesired fashion.

Bearing Mounts (92) Bearing mounts are located in the front or the rear of either the complex BL TE or each stage of the compound BL TE. These mounts are shrouded by (2) bearing housings and are located in the coolest locations possible to avoid hot exhaust gasses. These (92) mounts will also provide pressurized lubrication if necessary.

Porting: Chassis (114) intake ports (FIG. 19) are the features located in the front of either the complex BL TE or each stage of the compound BL TE allowing the intake of air for combustion. Chassis (121) exhaust ports are features located near the rear periphery of the complex BL TE chassis or around the periphery of the post-auxiliary stage to allow exhaust gases to escape to the ambient.

Frictionless Bearings: High Speed Fluid Bearings: Reducing friction in (3) bearings is important for increased efficiency, wear reduction, extended use at high speeds, overheating and premature bearing failure prevention. Essentially, a bearing can reduce friction by virtue of its shape, its material, by introducing and containing a fluid between surfaces or by separating the surfaces with an electromagnetic field.

Shape,' gains advantage usually by using spheres or rollers, or by forming flexure bearings.

Material, exploits the nature of the bearing material used. (An example would be using plastics that have low surface friction.)

Fluid, exploits the low viscosity of a layer of fluid, such as a lubricant or as a pressurized medium to keep the two solid parts from touching reducing the normal force between them.

Fields, exploit electromagnetic and magnetic fields, to keep solid parts from touching.

Combinations of these can even be employed within the same bearing. An example of this is where the cage is made of plastic, and it separates the rollers or balls, which reduce friction by their shape and finish.

Bearing speed is a function of bearing type, temperature, toad, material, dynamics {vibration) and mode of operation. Some bearing configurations can attain angular velocities of 500,000 rpm3.4 which is higher than what now is considered to be nominal BL TE operational speed.

Fluid Pumping: The chassis should incorporate lubrication and electrical subsystems commonly found in turbine equipment to support the above mentioned functionality.

Single Stage BL TE with Compression & Exhaust Auxiliary Stages:

FIG. 16 demonstrates the flexibility of the Compound BL TE using ganged stages. This diagram shows a (1) compression auxiliary stage, a (9) primary combustion stage and an (27) exhaust/evacuation auxiliary stage. The disks in the auxiliary stages are typically the same size as compression disks of the main stage (FIG. 17).

FIG. 18—Turbo Electric Configuration:

The Boundary Layer Turbine Engine's. output may be applied to any conventional torque conversion (transmission) device but the best performance can be expected when it is coupled with a motor-generator (or dynamo) to convert its output to an electrical form (FIG. 18). For example, an automobile operating with a reciprocating engine, a hydro-mechanical transmission and friction brakes is less than 7% efficient from fueling to vehicle propulsion. A BL TE system operating at 50% efficiency (21'2 times the efficiency of the piston driven engine), an electric dynamo operating at 80% efficiency (2½ times the efficiency of the hydro-mechanical transmission), and 4 electric motor driven wheels, each delivering an 80% conversion efficiency from electrical to kinetic energy promises a 32% efficiency fueling for vehicle propulsion. In addition, dynamic recovery of braking or downhill energy to battery storage for the next propulsion cycle and battery output used to augment the typical turbine response lag from accelerator demand to power delivery, increases the overall system efficiency. This system conservatively, promises greater than a 4% times gain of efficiency over the present day methods of vehicle propulsion without inclusion of the regenerative braking energy contribution.

This fuel to road performance boost is due to the higher overall operational efficiency of the BL TE and dynamo based system as contrasted to today's reciprocating engine and hydro-mechanical transmissions.

This invention can be used in place of any reciprocating engine application (automotive, airspace, marine, power tools, and many battery applications).

Battery replacement (FIG. 18) applications can be achieved using butane, propane, methane or any (but not necessarily) clean burning fuel with a small high speed generator output, a physically small electrical storage device (to filter transients), and single chip computerized controller to optimize engine efficiency and control battery charging. This combination can be produced in a very small package and can produce electrical power on demand for laptop computers, hand tools, personal power sources and a host of such applications supplying far more power and more endurance than rechargeable batteries.

Various uses of the BL TE are:

1. Automotive Power Applications
2. Marine Power Applications
3. Aircraft Power Applications
4. Battery replacement power applications
   Computer mobile and stationary devices power applications
   Hand held tools power applications
5. Electrical power generation
6. Electrical auxiliary/mobile power applications
7. Mechanical auxiliary power applications
8. Personal/mobile power sources

What is claimed is:

1. A high-speed, arrayed flat-disk, radial-flow turbine engine which maintains intake, compression, ignition and power exhaust in each main stage, the engine comprising:

a main stage having a first disk stack and a second disc stack, the first disc stack is positioned radially in line with the second disc stack, the first disc stack having a first plurality of discs with a first diameter, the second disc stack having a second plurality of discs with a second diameter, the first diameter is greater than the second diameter;

an intake seal disk of the first disk stack which incorporates a seal mechanism configured to prevent an escape of pressurized gasses;

a compressor section associated with the first disk stack, the disc stack having a compressor disk, the compressor section having a first plurality of discs;

a combustion chamber configured to receive fuel, the combustion chamber having the second plurality of discs;

a chassis configured to radially enclose the main stage, the chassis forming an inner area, the chassis is positioned adjacent to both the first plurality of discs and a second plurality of discs, a flame barrier configured to maintain ignition the flame barrier is disposed within the inner area;

wherein the compressor section directs air to the combustion chamber via the chassis;

an electrical ignitor configured to initiate combustion with the combustion chamber, the electrical ignitor is positioned within the inner area; and a series of ported disks of the first disk stack, the series of ported disks configured to extract energy of combustion and exhaust gasses via ports of the series of ported disks.

2. The engine of claim 1, wherein relative disk sizes associated with the first disk stack for internal stage compression and exhaust/evacuation.

* * * * *